US007454940B2

(12) United States Patent
Saitou

(10) Patent No.: US 7,454,940 B2
(45) Date of Patent: Nov. 25, 2008

(54) PRESS FORMING METHOD AND APPARATUS

(75) Inventor: Kazumi Saitou, Shizuoka (JP)

(73) Assignee: JATCO Ltd, Shizuoka (JP)

( * ) Notice: Subject to any disclaimer, the term of this patent is extended or adjusted under 35 U.S.C. 154(b) by 0 days.

(21) Appl. No.: 11/406,405

(22) Filed: Apr. 19, 2006

(65) Prior Publication Data

US 2006/0236741 A1 Oct. 26, 2006

(30) Foreign Application Priority Data

Apr. 20, 2005 (JP) ..... 2005-122598
Mar. 8, 2006 (JP) ..... 2006-062982

(51) Int. Cl.
*B21D 22/00* (2006.01)

(52) U.S. Cl. ..... 72/349; 72/348; 72/414

(58) Field of Classification Search ..... 72/349, 72/412, 414–416, 347, 348, 350
See application file for complete search history.

(56) References Cited

U.S. PATENT DOCUMENTS 2,510,024 A * 5/1950 Mayer ..... 72/397
3,748,889 A * 7/1973 Miller et al. ..... 72/382
5,775,060 A * 7/1998 Ferrero ..... 53/453
5,881,593 A 3/1999 Bulso, Jr. et al.
5,950,483 A 9/1999 Schneider et al.

FOREIGN PATENT DOCUMENTS

| | | | |
|---|---|---|---|
| DE | 195 40 294 A1 | | 4/1997 |
| FR | 673 127 A1 | | 8/1992 |
| JP | 9-024425 A | | 1/1997 |
| JP | 2001-314921 | * | 11/2001 |
| SU | 416 131 A1 | | 1/1974 |

* cited by examiner

*Primary Examiner*—Derris H. Banks
*Assistant Examiner*—Debra M Wolfe
(74) *Attorney, Agent, or Firm*—Foley & Lardner LLP

(57) ABSTRACT

A press forming method includes the following steps: (a) approaching an upper die to a lower die to form a space having a shape corresponding to at least one of concave and convex, the upper die having at least one of convex and concave, the lower die having at least one of concave and convex corresponding to at least one of convex and concave of the upper die; (b) forcing a workpiece disposed between the upper and lower dies, into the space so as to form at least one of preliminary concave and convex in the workpiece; (c) striking the upper die against the lower die so as to form at least one of concave and convex in the workpiece.

6 Claims, 15 Drawing Sheets

121
122
123
125
126
123n
124
O
123n
126
125
123f
123e
125f
124e
124f
124e
125f
123e
123f
W
42
41
133s
41e
137
136n
136
133f
135e
135f
135e
43
135e
135f
135e
133f
42
41
133s
41e
137
136n
136
136f
Lb
135
R1
133
134
135
Lb
132
136f
120
123
130
136
131
100

PRESS FORMING METHOD AND APPARATUS

BACKGROUND OF THE INVENTION

This invention relates to improvements in press forming method and apparatus by which a disk-shaped workpiece that has been bent is press-formed so as to be formed into a convex shape or a concave shape.

Hitherto, various types of press forming apparatuses are proposed and put into practical use. For example, the press forming apparatuses are used for forming a cover for a torque converter adopted in an automatic transmission. The cover is formed cup-shaped and has a cylindrical flange section whose one end is connected to a bottom section having an annular convex section. In order to form such cup-shaped products, a press forming is accomplished under combination of a plurality of single action press dies, as disclosed in Japanese Patent Laid-open Publication No. 2001-314921.

SUMMARY OF THE INVENTION

However, in the above conventional technique, four steps set forth below are necessary.

(1) First Step

The workpiece formed of a disk-shaped blank is subjected to a primary drawing in which the workpiece is bent to be formed into a convex shape.

(2) Second Step

The convex-shaped workpiece is subjected to a secondary drawing in which an annular convex (or concave) section is formed at a central section of the workpiece.

(3) Third Step

The workpiece formed of the disk-shaped blank is subjected to a flange-bending working in which an outer peripheral portion of the workpiece is bent to form a cylindrical flange section, leaving the central section or bottom surface having the annular convex (or concave) section as it is (4) Fourth Step The workpiece which has been subjected to the workings at the above-mentioned first to third steps is subjected to an upsetting forming in which equalization in thickness is made on the workpiece whose outer shape has been generally press-formed.

Consequently, the conventional technique needs various types of single action pressing dies for respective steps, and increases the number of steps for a pressing process, so that there arises a problem of lowering a manufacturing efficiency for the formed part. Additionally, if the workpiece is separately press-formed by using a plurality of single action pressing dies as in the conventional technique, the rigidity of a corner section where the cylindrical flange section is bent to the bottom surface of the workpiece W is increased; however, the rigidity of the annular convex section press-formed at the bottom surface of the workpiece is low. Therefore, there arises a fear that the annular convex section makes its buckling, damage or the like upon receiving an external force.

Hence, in case that the press forming is carried out by a conventional press forming apparatus that adopts the above-mentioned single action pressing dies, a thick workpiece must be used in order to prevent the annular convex section from its buckling, damage or the like. Therefore, there arises a problem of increasing a cost of material. Furthermore, in a pressing working, it is necessary to increase a pressing force (or load) applied to the workpiece by an amount corresponding to an increase in thickness of the workpiece. This increases loads applied to various elements (or parts) constituting each single action pressing die, so that there arises a problem of shortening the life of the apparatus.

In view of the above problems, it is an object of the present invention is to provide press forming method and apparatus which can effectively overcome drawbacks encountered in a conventional press forming apparatus.

Another object of the present invention is to provide press forming method and apparatus which improve a manufacturing efficiency, a cost of material and a life of the apparatus which are all degraded in the conventional press forming apparatuses in which the disk-shaped workpiece is subjected to various press forming steps in order to form the annular convex section or annular concave section at the bottom surface of the workpiece, and the cylindrical flange section by bending the above-mentioned workpiece.

A further object of the present invention is to provide press forming method and apparatus which can largely reduce the number of steps for forming a formed part having convex or concave, as compared with the conventional press forming method and apparatuses.

A still further object of the present invention is to provide press forming method and apparatus by which a step for forming convex or concave in a workpiece and a step for upsetting the workpiece can be simultaneously accomplished at a stretch or by one stroke of a pressing die.

A first aspect of the present invention resides in a press forming method includes the following steps: (a) approaching an upper die to a lower die to form a space having a shape corresponding to at least one of concave and convex, the upper die having at least one of convex and concave, the lower die having at least one of concave and convex corresponding to at least one of convex and concave of the upper die; (b) forcing a workpiece disposed between the upper and lower dies, into the space so as to form at least one of preliminary concave and convex in the workpiece; (c) striking the upper die against the lower die so as to form at least one of concave and convex in the workpiece.

A second aspect of the present invention resides in a press forming method includes the following steps: (a) approaching an upper die to a lower die to form at least one of preliminary concave and convex in a workpiece disposed between the upper and lower dies so as to accomplish a preliminary forming, the upper die having at least one of convex and concave, the lower die having at least one of concave and convex corresponding to at least one of convex and concave of the upper die; (b) forcing the workpiece disposed between the upper and lower dies into a forming space by using a reaction force due to the preliminary forming, the forming space being formed between the upper and lower dies; (c) striking the upper die against the lower die so as to form at least one of concave and convex in the workpiece.

A third aspect of the present invention resides in a press forming apparatus including a lower die. The lower die includes a first punch on which a disk-shaped workpiece is to be mounted. A pushing projection is disposed outside the first punch and adjacent to the first punch so as to accomplish an upsetting for the workpiece upon contacting with a cylindrical bent end of the workpiece. An upper die includes a drawing die disposed to face to the first punch and cooperating with the first punch upon approaching the lower die so as to form a cylindrical section in the workpiece by bending the outer peripheral portion of the workpiece upon the approaching of the upper die. The upper die is struck to the lower die so as to press-form a cup-shaped formed part. The formed part includes the cylindrical section and a bottom section contiguous with the cylindrical section, and formed with at least one of annular concave or convex.

A fourth aspect of the present invention resides in a press forming apparatus including a lower die. The lower die has at least one of concave and convex and includes a core die having at least one of concave and convex. A lift die is disposed radially outside and adjacent to the core die and movable upward and downward relative to the core die in a state where a disk-shaped workpiece is mounted on the lift die. An upsetting die is disposed radially outside and adjacent to the lift die and contactable with a bent end of the workpiece which has been bent upon downward movement of the lift die. An upper die has at least one of convex and concave corresponding to the shape in the lower die and includes a core punch having at least one of convex and concave corresponding to at least one of the concave and convex of the core die. An upsetting punch is located radially outside and adjacent to the core punch and has a projection for bending an outer peripheral portion of the workpiece mounted on the lift die, and a holding surface for contacting the bent end of the workpiece to the upsetting die in cooperation with the lift die so as to force the workpiece into a space formed between the core die and the core punch by using a reaction force due to contacting of the bent end of the workpiece. The upper die is approached to the lower die to bent the disk-shaped work piece, and struck to the lower die to form at least one of convex and concave in the disk-shaped work piece.

A fifth aspect of the present invention resides in a press forming apparatus including a lower die. The lower die has at least one of concave and convex and includes a base die having at least one of concave and convex, and an upsetting die disposed radially outside and adjacent to the base die and formed with a depression serving as a groove between the upsetting die and the base die. A bent end of a workpiece is insertable in the groove. An upper die is formed into at least one of convex and concave shape corresponding to the shape in the lower die and includes an upsetting punch having at least one of convex and concave corresponding to at least one of the concave and convex of the base die, and a guide surface for contacting the bent end of the workpiece pressed to the upsetting punch in cooperation with the base die to the upsetting die so as to force the workpiece into a space formed between the base die and the upsetting punch by using a reaction force due to contacting of the bent end of the workpiece. The upper die is approached and struck to the lower die to form at least one of convex and concave in the bent disk-shaped work piece.

BRIEF DESCRIPTION OF THE DRAWINGS

In the drawings, like reference numerals designate like parts and elements throughout all figures in which.

DETAILED DESCRIPTION OF THE INVENTION

Referring now to attached drawings, a first embodiment of a press forming apparatus according to the present invention is illustrated.

Figure 5A:
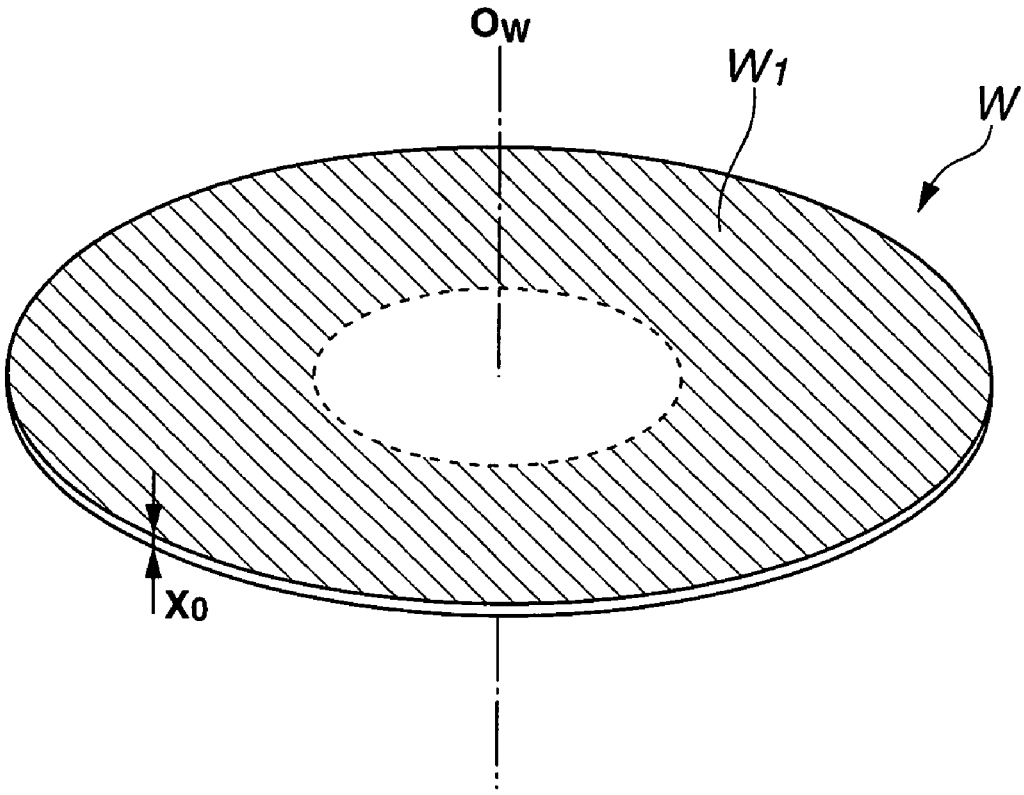
FIG. 5A is a perspective view of a workpiece to be worked in the press forming apparatus of FIG. 1.
Figure 5B:
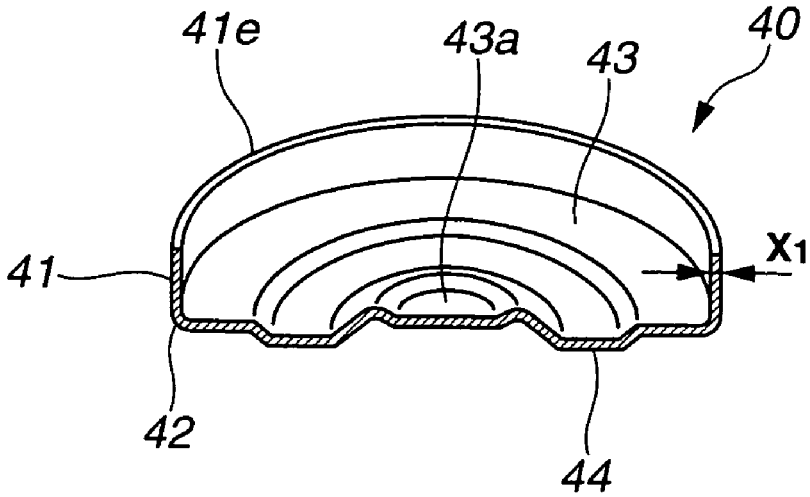
FIG. 5B is a fragmentary perspective view partly in section of a formed part obtained by press forming of the workpiece in the press forming apparatus of FIG. 1.
Figure 6A:
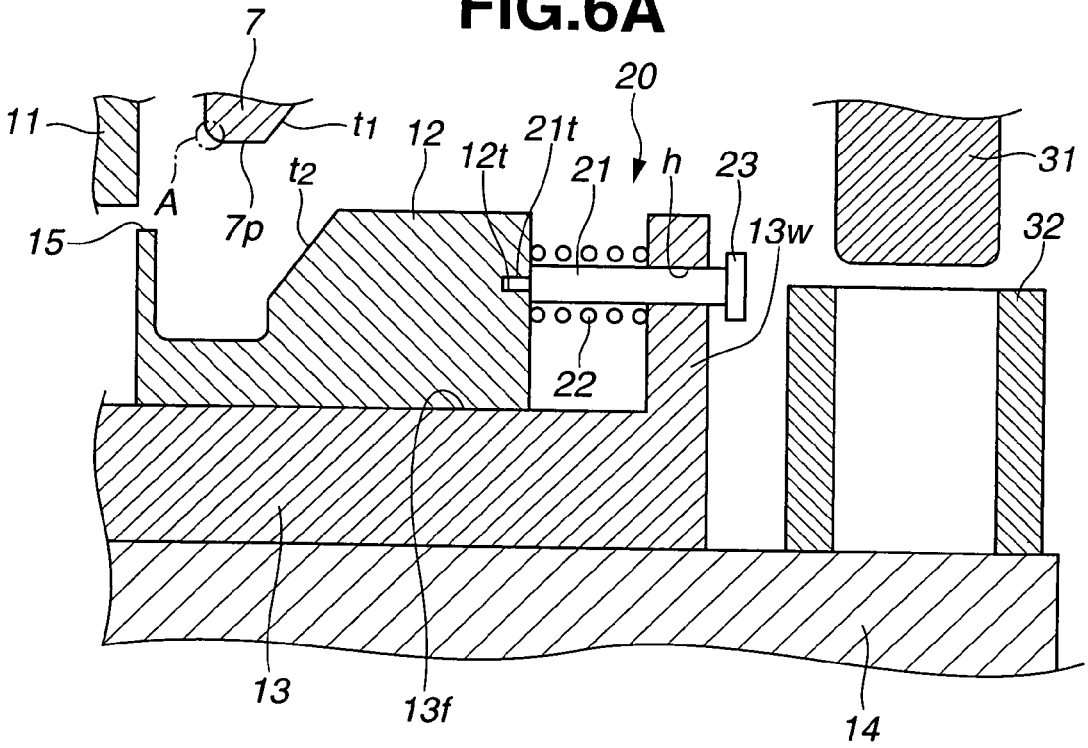
FIG. 6A is a fragmentary enlarged vertical sectional view of the press forming apparatus of FIG. 1, showing a run-off mechanism and a return means.
Figure 6B:
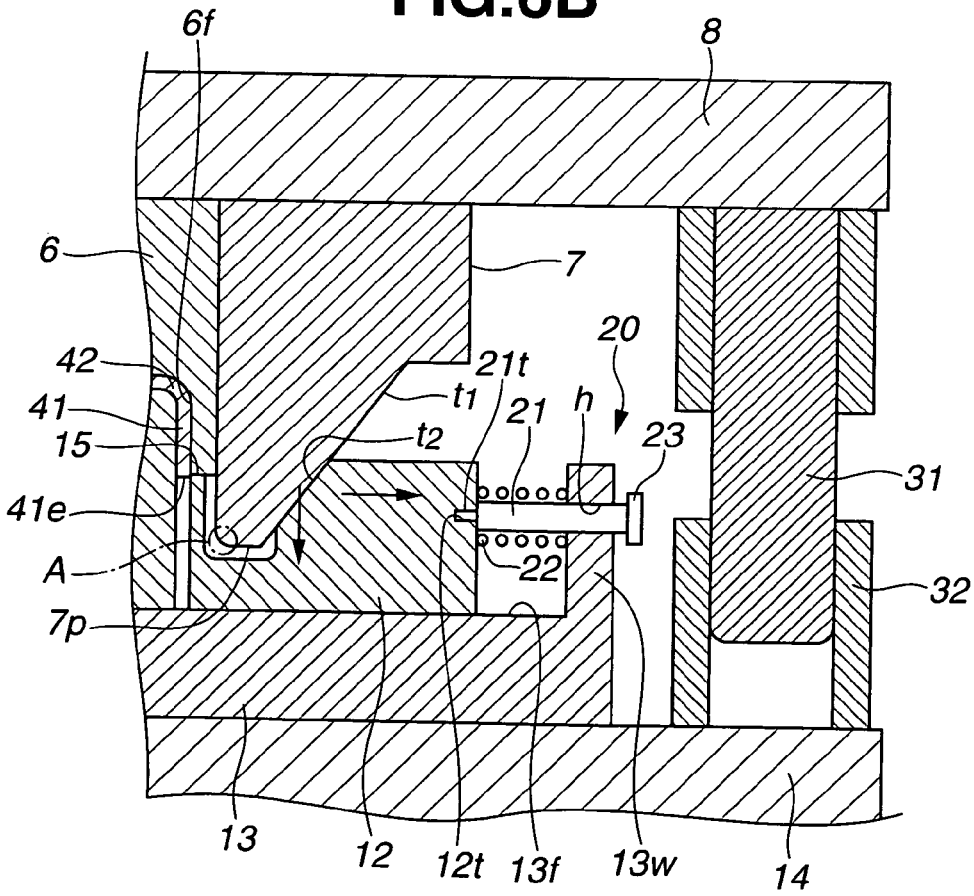
FIG. 6B is a fragmentary enlarged vertical sectional view of the press forming apparatus of FIG. 1, showing the run-off mechanism and the return means.
Figure 7A:
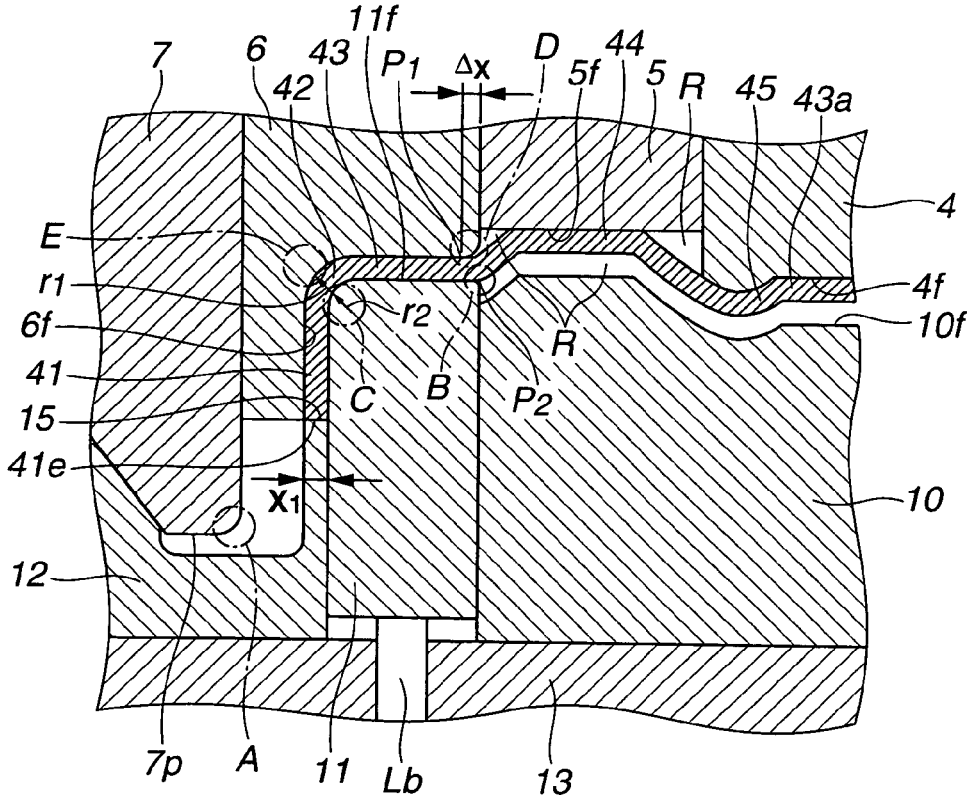
FIG. 7A is a fragmentary enlarged vertical sectional view of the press forming apparatus of FIG. 1, showing an example of a die for press forming an annular convex section in the workpiece.
Figure 7B:
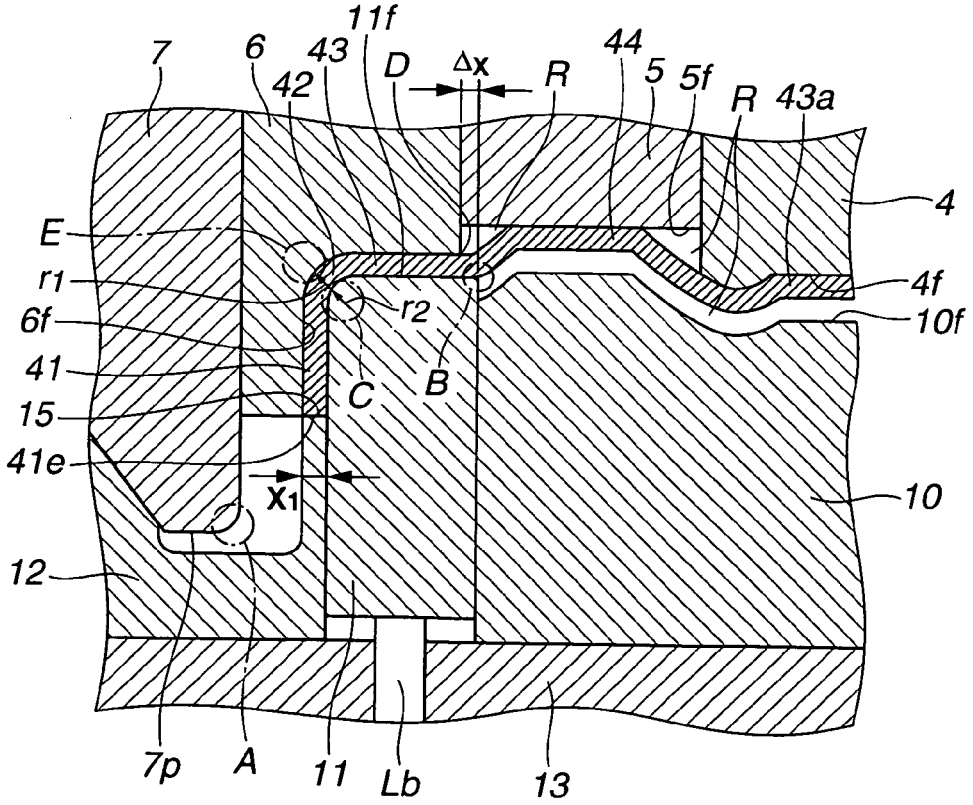
FIG. 7B is a fragmentary enlarged vertical sectional view similar to FIG. 7A, but showing another example of the die for press forming the annular convex section in the workpiece.

FIGS. 1 to 4 are vertical cross-sectional views of a press forming apparatus 1 of the first embodiment according to the present invention, in which each view shows one of steps constituting a press forming method. FIGS. 5A and 5B are perspective views which respectively show a workpiece W to be worked by the press forming apparatus 1 and a formed part 40 which is obtained by press forming the workpiece 1 by the press forming apparatus 1. FIGS. 6A and 6B are fragmentary enlarged cross-sectional views of the press forming apparatus, showing a run-off mechanism and a return means or device which will be discussed after. FIGS. 7A and 7B are fragmentary enlarged cross-sectional views which respectively exemplify dies for press forming an annular convex section 44 at a bottom section 43 of the workpiece W.

The workpiece W is a disk-shaped steel plate member as shown in FIG. 5A. The formed part 40 includes a cylindrical flange section (hereinafter referred to as a "cylindrical section") 41 formed by bending an outer peripheral portion W1 of the workpiece W. The cylindrical section 41 is integrally connected with a bend-less circular bottom section 43 through an annular bent section 42. The bottom section 43 is formed coaxially with an annular convex section 44. Therefore, the formed part 40 is formed into the generally cup shape.

Figure 1:
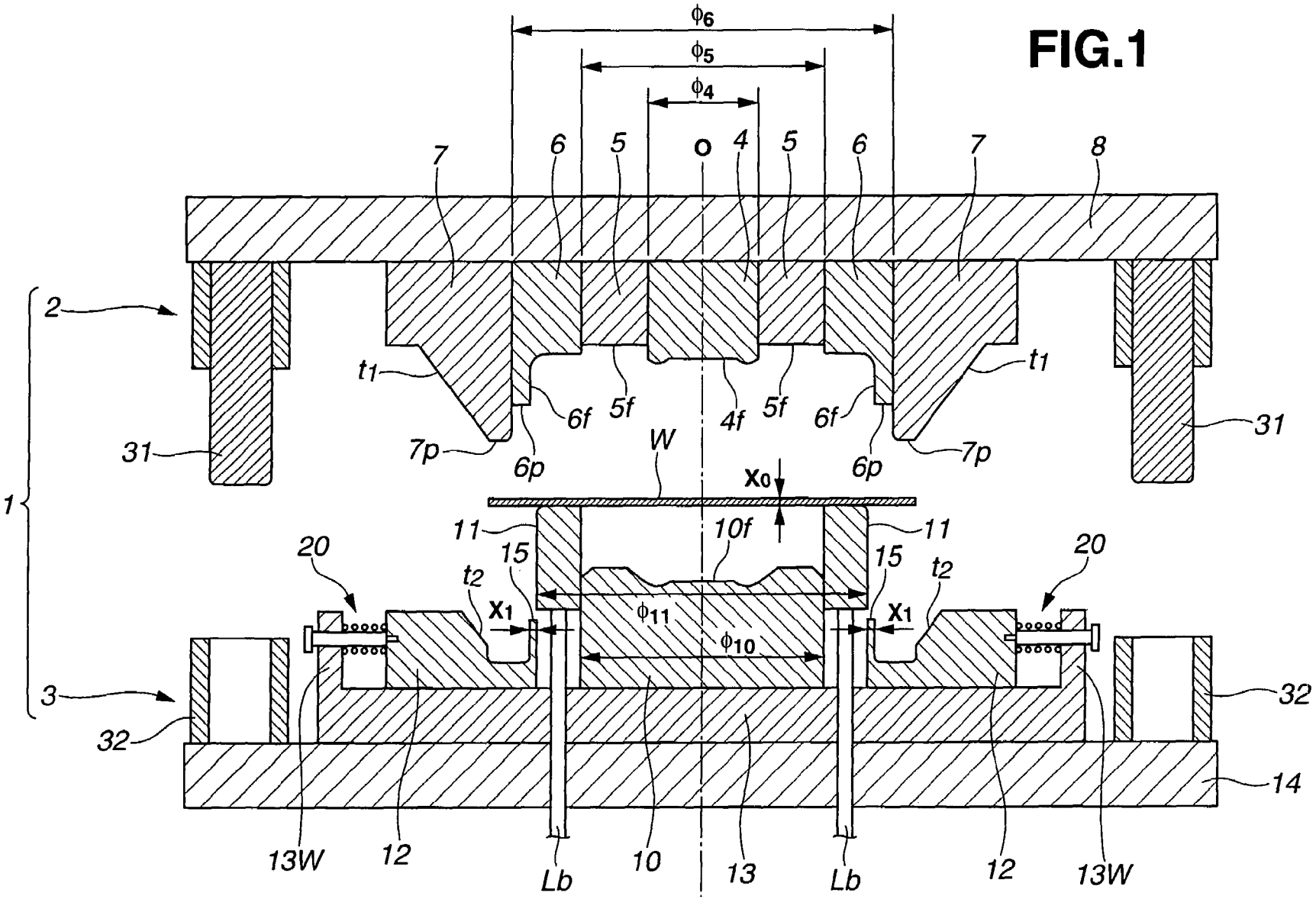
FIG. 1 is a vertical cross-sectional view of an embodiment of a press forming apparatus according to the present invention, showing a "blank setting" state of the press forming apparatus.

The press forming apparatus 1 includes an upper die 2 and a lower die 3 as shown in FIG. 1.

The upper die 2 includes a center punch 4, a punch 5 for forming an annular convex section, a drawing die (hereinafter referred to as an "upsetting punch") 6 and a cam die (hereinafter referred to as a "cam punch") 7 which are positioned coaxially with axis O and arranged successively radially outwardly in order described. Each of the upper surfaces of the center punch 4, the punch for forming the annular convex section, the upsetting punch 6 and the cam die 7 is fixed with an upper die plate 8 as a single member.

The center punch 4 is in a generally cylindrical shape and has a circular lower surface 4*f* which serves as a pressing surface for pressing the workpiece W. The punch 5 for forming the annular convex section is positioned outside the center punch 4 and adjacent to the center punch 4. The punch 5 for forming the annular convex section is in a generally hollow cylindrical shape and formed with a through hole at its radially inside section. The punch 5 includes an annular lower surface 5*f* which serves as a ceiling for deciding the height of the annular convex section 44. Consequently, the lower surface 5*f* of the punch 5 for forming the annular convex section is positioned higher than the pressing surface or lower surface 4*f* of the center punch 4. Various combination of the center punch 4 and the punch 5 for forming the annular convex section may be provided to suitably change the outer diameter $\phi_4$ of the center punch 4, the outer diameter $\phi_5$ of the punch 5 for forming the annular convex section, and the shape of the pressing surface 4*f* of the center punch 4 in accordance with the shape of the formed part 40.

The upsetting punch 6 is also in a generally hollow cylindrical shape and formed with a through hole at its radially inside section. A lower side section of the upsetting punch 6 is formed with an annular curved surface 6*f* which is descendingly curved in a radially outward direction. The curved surface 6*f* is integrally connected with an annular projection 6*p* so that these curved surface 6*f* and projection 6*p* serve as a pressing surface for pressing the workpiece W. Additionally, the outer diameter $\phi_6$ of the upsetting punch 6 can also be suitably changed in accordance with the shape of the formed part 40.

The cam punch 7 is also in a generally hollow cylindrical shape and formed with a through hole at its radially inside section. The cam punch 7 has a lower projecting section 7*p* whose lower surface is located lower than that of the projection 6*p* of the upsetting punch 6 as shown in FIG. 1. The lower projecting section 7*p* is integrally connected with a first tapered surface t1 which is ascendingly inclined in a radially outward direction. Additionally, the lower projecting section 7*p* serves as a pushing surface for bending the workpiece W and includes an inner edge portion A whose corner is chamfered, as shown in FIG. 6, in order not to damage the workpiece W. Furthermore, the first tapered surface t1 serves as a sliding surface which is slidably contactable with a second tapered surface t2 of a cam slide punch or upsetting die (hereinafter referred to as a "cam slide die") 12 which will be described below.

On the other hand, the lower die 3 includes a lower die punch (hereinafter referred to as a "core die") 10, a lift punch (hereinafter referred to as a "lift die") 11 and the cam slide dies 12 which are disposed on a cam slide floor 13 to be coaxial with the axis O and arranged successively radially outwardly in the order mentioned. The cam slide floor 13 includes an annular outside wall 13*w* surrounding the core die 10, the lift die 11 and the cam slide dies 12. A return means 20, which will be described below, is disposed between the outside wall 13*w* and the cam slide dies 12. The lower surface of the cam slide floor 13 is tightly in contact with the upper surface of a lower die plate 14 and fixed with the lower die plate 14 as a single member.

The core die 10 is in a generally cylindrical shape and includes an upper surface 10*f* which has a convex-concave surface corresponding to the pressing surface 4*f* of the center punch 4 and a surface facing to the pressing surface 5*f* of the punch 5 for forming the annular convex section. Therefore, the upper surface 10*f* serves as a pressing surface for pressing the workpiece W. Additionally, the outer diameter $\phi_{10}$ of the core die 10 is generally the same as the outer diameter $\phi_5$ of the punch 5 for forming the annular convex section. Furthermore, the core die 10 may be replaced so as to suitably change the outer diameter $\phi_{10}$ of the core die 10 in accordance with the shape of the formed part 40. More specifically, both the center punch 4 and the punch 5 for forming the annular convex section serves as a core punch having a convex-concave shape corresponding to the core die 10.

The lift die 11 is positioned outside and adjacent to the core die 10. The lift die 11 is in a generally hollow cylindrical shape so as to be formed with a through hole at its radially inside section. Furthermore, the lift die 11 is upwardly and downwardly movable by an elevating device (not shown) such as a device driven by hydraulic pressure. The elevating device is connected to the lift die 11 through a lift bar Lb piercing the cam slide floor 13 and the lower die plate 14 which will be discussed below. The lift die 11 has an upper or supporting or holding surface 11*f* which serves as a supporting surface for positioning and supporting the workpiece W as shown in FIG. 7. The lift die 11 also includes an annular inner edge portion B forming generally right angles in section and an annular outer edge portion C formed into a curved surface. Additionally, the outer diameter $\phi_{11}$ of the lift die 11 may be suitably changed in accordance with the shape of the formed part 40. This lift die 11 corresponds to a first punch.

The cam slide dies (for example, eight cam slide dies) 12 are arranged coaxial with the axis O. Each cam slide die 12 is disposed to be in tight contact with the adjacent cam slide die so that the cam slide dies 12 are arranged in a generally hollow cylindrical shape and formed with a through hole at its radially inside section in a state of FIG. 3. Additionally, each cam slide die 12 is provided at its inner peripheral section with a pushing projection 15 which extends toward the upsetting punch 6 from the upper side of the inner peripheral portion. The pushing projection 15 is formed integral with the main body of the cam slide die 12. Thickness $x_1$ of the pushing projection 15 in radial direction is generally equal to or more than the thickness $x_0$ of the workpiece W which is in a state of such a blank as not to be pressed.

Additionally, each cam slide die 12 includes the second tapered surface t2 which is located radially outside the pushing projection 15 and ascendingly inclines in a radially outward direction. The second tapered surface t2 serves as a sliding surface to which the first tapered surface t1 of the cam punch 7 is slidably contactable. Additionally, as shown in FIG. 6A, each cam slide die 12 is retained by the cam slide floor 13 and radially movable along a floor surface 13*f* of the cam slide floor 13. Therefore, as shown in FIG. 6B, when the upper die 2 is moved downward so that the first tapered surface t1 of the cam punch 7 downwardly pushes the second tapered surface t2 of each cam slide die 12, each cam slide die 12 can be radially outwardly moved relative to the axis O along the floor surface 13*f* of the cam slide floor 13 in such a manner that the adjacent cam slide dies 12 are separated from each other. That is to say, the run-off mechanism is constituted by the cam slide dies 12 having the second tapered surface t2 to which the first tapered surface t1 of the cam punch 7 is slidably contactable, and the cam slide floor 13 retaining the cam slide dies 12 to be radially movable.

On the other hand, the movement of each cam slide die 12 in a radially inward direction is made by the return means 20. As shown in FIG. 6A, the return means 20 includes a rod member 21 and a spring 22. The rod member 21 is formed at its one end with a male thread 21*t* which is threadably engaged with a female thread 12*t* of the cam slide die 12. The rod member 21 slidably pierces a lateral hole h formed in the outside wall 13*w* of the cam slide floor 13. Additionally, the rod member 21 is provided at its other end with an engaging head 23 so that the rod member 21 piercing the lateral hole h is restricted in its radially inward movement by the engaging head 23. The spring 22 is disposed between the cam slide die 12 and the outside wall 13*w* and positioned to surround the rod member 21. That is to say, the cam slide die 12 is biased radaially inward by the spring 22, and stopped at a (stop) position at which the engaging head 23 is contacted with an outside surface of the outside wall 13*w*. This stop position is an initial position at which an outside surface of the lift die 11 is in contact with an inside surface of the cam slide die 12.

Furthermore, the upper die plate 8 of the press forming apparatus 1 is a generally rectangular plate and provided with guide posts 31 located at four corners. Additionally, the lower die plate 14 positioned corresponding to the upper die plate 8 is also a generally rectangular plate and provided with guide bushes 32 located at positions corresponding to the respective guide posts 31 of the upper die plate 8. Each of the guide post 31 is slidably fitted with each of the guide bush 32. Therefore, the guide posts 31 and the guide bushes 32 are provided for preventing the upper die 2 and the lower die 3 from being displaced from each other during striking of the upper and lower dies, and for guiding the upper die 2 in a state of being struck to the lower die 3 when the upper die 2 is moved downward. Additionally, it will be understood that the upper die plate 8 may be provided with the guide bushes 32, while the lower die plate 14 may be provided with the guide posts 31. The plate shape of the upper die plate 8 and the lower die plate 14 is not limited to the rectangular shape.

Next, operation of the press forming apparatus 1 will be discussed with reference to drawings.

The press forming apparatus 1 can accomplish a press forming including four steps of (1) blank setting, (2) drawing, (3) upsetting, and (4) restriking, only by moving the upper die 2 downward. Hereinafter, each step of (1) to (4) will be successively discussed.

(1) Blank Setting (See FIG. 1)

"Blank setting" is a step for setting the disk-shaped workpiece W.

As shown in FIG. 1, firstly in the "blank setting", the upper die 2 is raised by a driving device (not shown) to a certain position which has been previously set, and stands by at the position. Next, the lift die 11 is raised by the above-mentioned elevating device from the cam slide floor 13 to a certain position which has been previously set, and stopped at the certain position. By this, an operator can mount the workpiece W on the supporting or holding surface 11*f* of the lift die 11. At this time, the workpiece W is mounted in such a manner that its axis $O_w$ agrees to the axis O of the lift die 11.

Figure 2:
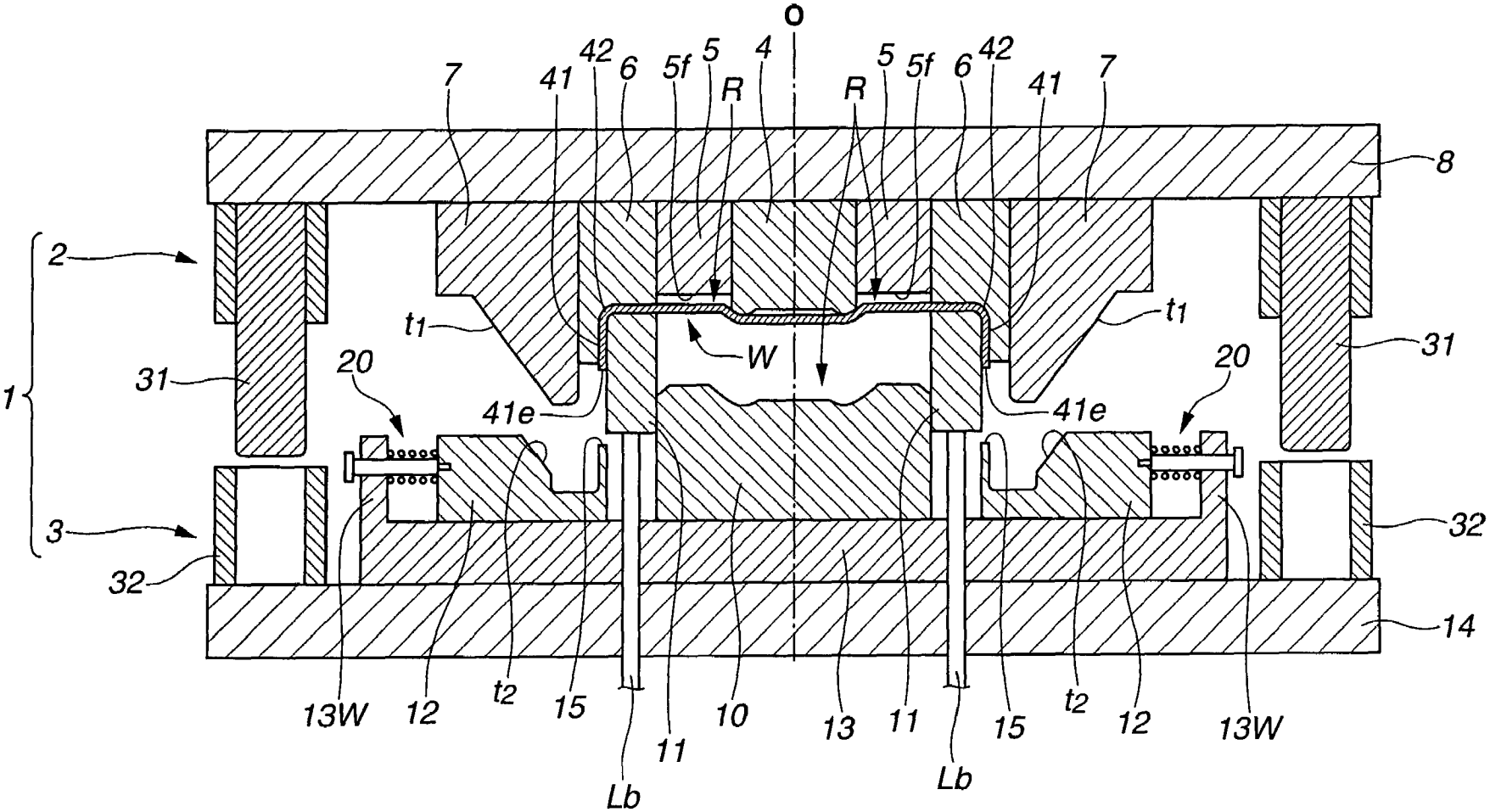
FIG. 2 is a vertical cross-sectional view similar to FIG. 1, but showing a "drawing" state of the press forming apparatus.

(2) Drawing (See FIG. 2)

"Drawing" is a step for forming the cylindrical section 41 at the outer peripheral section of the workpiece W by bending.

As shown in FIG. 2, in the "drawing", the upper die 2 is moved downward by the above-mentioned driving device. More specifically, at first the lower projecting section 7*p* of the cam punch 7 annularly pushes the outer peripheral portion W1 of the workpiece W thereby slightly drawing the outer peripheral portion W1 downward. Next, the upper die 2 is further moved downward so that the outer peripheral portion W1 of the workpiece W is pressed between the curved surface 6*f* of the upsetting punch 6 and the lift die 11 in order to form the cylindrical section 41. By this, the outer peripheral portion W1 of the workpiece W is bent to some extent by the lower projecting section 7*p*, and thereafter the outer peripheral portion W1 is bent at right angles. Consequently, the workpiece W can be prevented from its cracking, buckling or the like by bending the workpiece W at right angles at a stretch.

After forming the cylindrical section 41 in the workpiece W, the lift die 11 is moved downward with the upper die 2 by the pressing force generated upon downward movement of the upper die 2. In other words, the workpiece W provided with the cylindrical section 41 is sandwiched between the holding surface of the upsetting punch 6 and the holding surface of the lift die 11, and moved downward as a single member.

(3) Upsetting (See F*ig*. 3)

"Upsetting" is a step for promoting plastic flow in the workpiece W so as to form the annular convex section 44.

Figure 3:
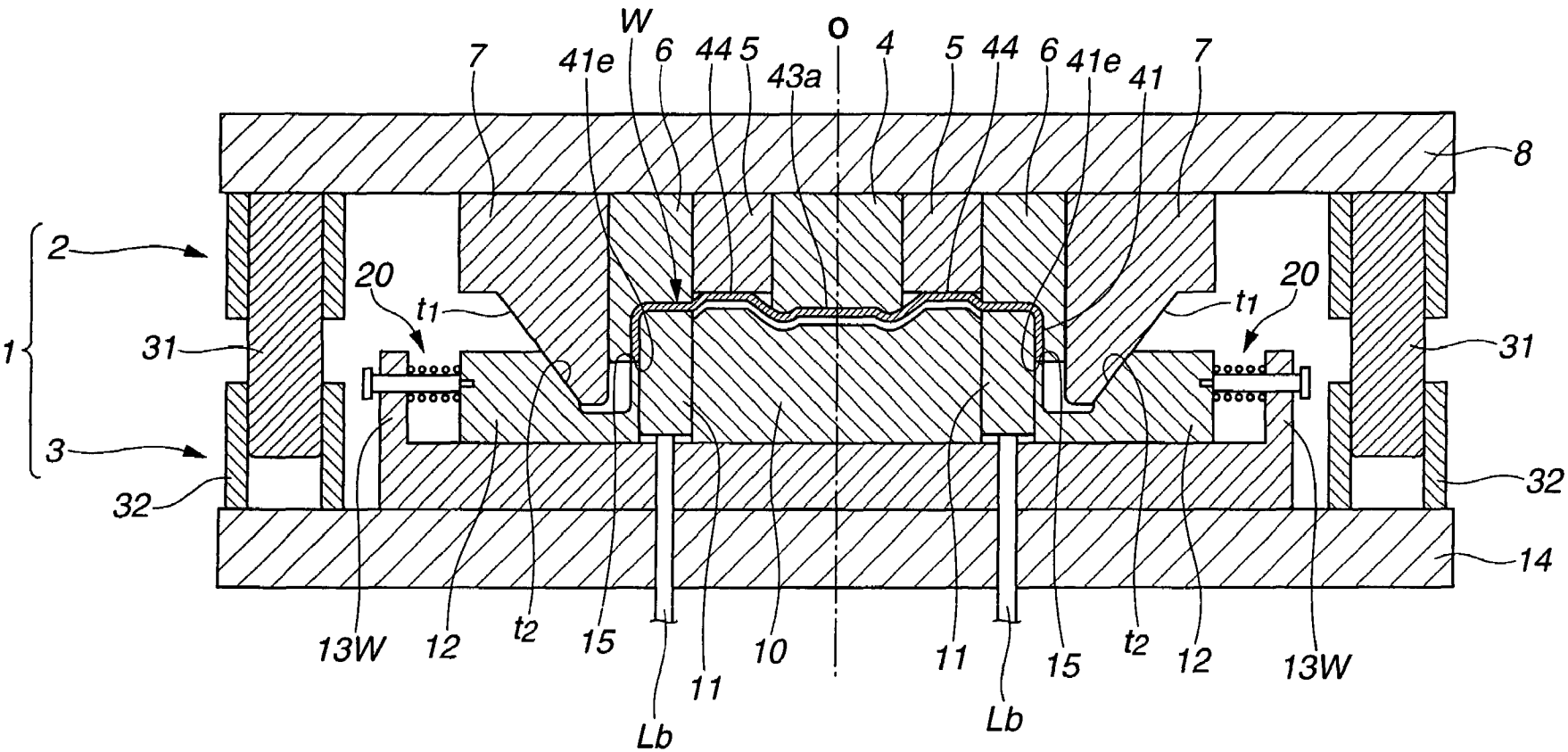
FIG. 3 is a vertical cross-sectional view similar to FIG. 1, but showing an "upsetting" state of the press forming apparatus.

As shown in FIG. 3, in the "upsetting", the upper die 2 is further moved downward so that a flange end section 41*e* of the workpiece W sandwiched between the upsetting punch 6 and the lift die 11 is brought into contact with the pushing projection 15 of the cam slide die 12 so that the flange end section 41*e* receives a pressing force generated upon downward movement of the upper die 2. Consequently, the pressing force is applied from the pushing projection 15 through the flange end section (hereinafter referred to as a "bent end") 41*e* to the bottom section 43 so that the plastic flow occurs in the workpiece W. Simultaneously, since the workpiece W is in a disk shape, reaction force acts in a direction from the axis $O_w$ of the workpiece W to the bent end 41*e* against the pressing force from the bent end 41*e*. Consequently, these pressing force and reaction force accomplish the upsetting for the workpiece W placed between the core die 10 and the core punch 4 and 5 within a space R defined between the core die 10 and the core punch 4 and 5. As a result, the bottom section 43 of the workpiece W is formed with a central section (hereinafter referred to also as an "upper bottom section") 43*a* and the annular convex section 44 which projects in the opposite direction to the cylindrical section 41. Additionally, at this time, the upsetting is accomplished by applying the pressing force from the pushing projection 15 to the bent end 41*e* thereby producing plastic flow in the workpiece W. Therefore, it becomes possible to increase each thickness of the bent section 42 and the annular convex section 44 which tend to become relatively low in rigidity. As a result, the formed part 40 becomes high in rigidity. Furthermore, by employing such a technique that the annular convex section 44 is formed at the bottom section 43 of the workpiece W by applying the pressing force from the pushing projection 15 to the bent end 41*e* as described in this embodiment, the annular convex section 44 can be prevented from its cracking, buckling or the like.

In case of forming the annular convex section 44 at the bottom section 43 of the workpiece W which section projects in the opposite direction to the cylindrical section 41, an inner edge portion D of the upsetting punch 6 and the inner edge portion B of the lift die 11 are arranged to generally align in radial direction with each other as shown in FIG. 7A. Additionally, the inner edge portion D of the upsetting punch 6 is chamfered, while the inner edge portion B of the lift die 11 forms generally right angles in section. In other words, the position of a contacting point P1 between the inner edge portion D of the upsetting punch 6 and the workpiece W is radially outwardly set back by Δx relative to the position of a contacting point P2 between the inner edge portion B of the lift die 11 and the workpiece W. Therefore, the pressing force applied from the pushing projection 15 of the cam slide die 12 to the bent end 41*e* is upwardly released along the chamfered inner edge portion D of the upsetting punch 6. By this, with the "upsetting", the annular convex section 44 is formed at the bottom section 43 of the workpiece W to project in the opposite direction to the cylindrical section 41 in a space R defined between the punch 5 for forming the annular convex section and the core die 10.

Contrary to the above, in case of forming the annular convex section 44 on the bottom section 43 of the workpiece W which section projects in the same direction as the body section 41, the position of the contacting point P2 between the inner edge portion B of the lift die 11 and the workpiece W radially outwardly is set back by Δx relative to the position of the contacting point P1 between the inner edge portion D of the upsetting punch 6 and the workpiece W in a manner opposite to the manner shown in FIG. 7A. Additionally, the inner edge portion D of the upsetting punch 6 forms generally right angles in section, while the inner edge portion B of the lift die 11 is chamfered. Therefore, the pressing force applied from the pushing projection 15 of the cam slide die 12 to the bent end 41*e* is downwardly released along the chamfered inner edge portion B of the lift die 11. By this, the annular convex section 44 projecting in the same direction as the body section 41 is formed at the bottom section 43 of the workpiece W.

Another example of the "upseting" is shown in FIG. 7B in which the inner edge portion D of the upsetting punch 6 forms generally right angles in section. Additionally, the position of the inner edge portion D of the upsetting punch 6 radially outwardly is set back by Δx relative to the position of the inner edge portion B of the lift die 11. In this case, the pressing force applied from the pushing projection 15 of the cam slide die 12 to the bent end 41*e* is upwardly released to the side of the upsetting punch 6 which side is spatially opened thereby forming the annular convex section 44 projecting in the opposite direction to the body section 41. On the other hand, in case that the position of the inner edge portion B of the lift die 11 is radially outwardly set back by Δx relative to the position of the inner edge portion D of the upsetting punch 6 in a manner opposite to the manner shown in FIG. 7B, the pressing force applied from the pushing projection 15 of the cam slide die 12 to the bent end 41*e* is downwardly released to the side of the lift die 11 which side is spatially opened, thereby forming the annular convex section 44 projecting in the same direction as the body section 41. In these cases, it is preferable to chamfer the set-back inner edge portion B of the lift die 11 and the set-back inner edge portion D of the upsetting punch 6.

In the "upsetting", it is preferable to set a curvature radius r1 of a most curved section E at the curved surface 6*f* of the upsetting punch 6 to be larger than a curvature radius r2 of the outer edge portion C of the lift die 11 (r1>r2). In this case, plastic flow can readily occurs in the workpiece W, and additionally the bent section 42 of the workpiece W can be prevented from its cracking, bucking or the like. Additionally, the shape of the most curved section E of the upsetting punch 6 is not limited to the curved surface so that a tapered surface or a combination of a tapered surface and a curved surface may be adopted to the most curved section E.

Figure 4:
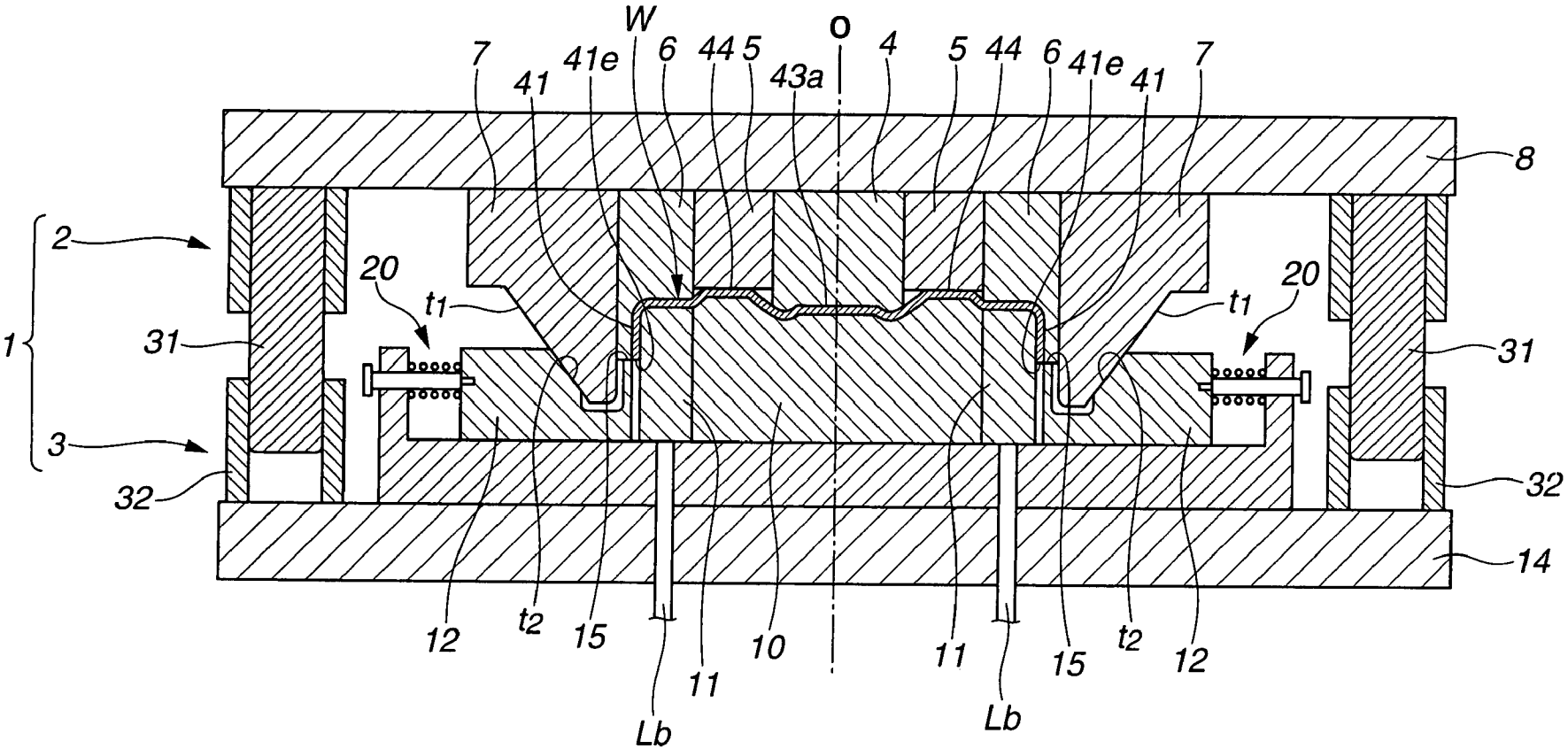
FIG. 4 is a vertical cross-sectional view similar to FIG. 1, but showing a "restriking" state of the press forming apparatus.

(4) Restriking (See FIG. 4)

"Restriking" is a step for accomplishing a finishing by completing the shape of the formed part.

With downward movement of the upper die 2, the upper bottom section 43*a* and the annular convex section 44 are formed at the bottom section 43 of the workpiece W, and simultaneously the first tapered surface t1 provided on the cam punch 7 is brought into contact with the second tapered surface t2 provided on the cam slide die 12.

As shown in FIG. 4, in the "restriking", the upper die 2 is further moved downward after the formation of the upper bottom section 43*a* and the annular convex portion 44 upon the "upsetting" so that the first tapered surface t1 is brought into contact with the second tapered surface t2. Therefore, each cam slide die 12 is radially outwardly pushed away by the cam punch 7 against the biasing force of the spring 22 so that adjacent cam slide dies 12 are separated from each other and radially spread. At this time, the cam slide dies 12 are slidably moved on the cam slide floor 13 as shown in FIG. 6B. In other words, the cam slide die 12 is radially outwardly moved with downward movement of the cam punch 7 against the biasing force of the spring 22 thereby separating the pushing projection 15 from the bent end 41*e* of the workpiece W as shown in FIG. 6B. As a result, the restriking is accomplished to the workpiece W in a state of being sandwiched between the upper die 1 including the center punch 4, punch 5 for forming annular convex section and the upsetting punch 6, and the lower die 3 including the core die 10 and the lift die 11 as shown in FIG. 4. Consequently, when the "restriking" is accomplished, the bent end 41*e* of the workpiece W does not receive unnecessary pressing force from the pushing projection 15 so that the bent section 42 of the workpiece W can be prevented from its cracking, buckling or the like. As a result, a pressed formed part can be manufactured at a high accuracy.

After completion of the "restriking", the upper die 2 is raised by the driving device (not shown) so that each cam slide die 12 is radially inwardly pushed back toward the axis O with the biasing force of the spring 22 disposed between the cam slide die 12 and the outside wall 13*f* of the cam slide floor 13. Therefore, the adjacent cam slide dies 12 are close with each other. By this, the cam slide dies 12 return to positions at which the adjacent cam slide dies 12 are in tight contact with each other so that the cam slide dies 12 takes a generally cylindrical shape as a whole. At this time, as shown in FIG. 6A, the engaging head 23 of the rod member 21 is returned to the above-mentioned initial position at which the engaging head 23 is in contact with the outside surface of the outside wall 13*w*.

In the return means 20, the means for positioning the cam slide dies 12 at the initial position is not limited to such a configuration that the engaging head 23 is contacted with the outside surface of the outside wall 13*w*, and therefore the positioning means may take various configurations. For example, a stopper projectably disposed on the floor surface 13*f* of the cam slide floor 13 may be used as the positioning means. This stopper restricts movement of the cam slide die 12 upon contact between the stopper and the cam slide die 12. More specifically, the cam slide dies 12 arranged on a circle coaxial with the axis O are spaced from each other by a certain distance. Each side surface of the cam slide die 12 is provided with a projection extending toward the facing side surface of the adjacent cam slide die 12. This projection is contacted with the above-mentioned stopper so as to position the cam slide die 12 at the initial position. Additionally, in this configuration, it is preferable to dispose a pentroof-shaped guide portion extending in the sliding direction of the cam slide die 12 on the top section of each stopper so as to slidably guide an upper surface of the above-mentioned projection.

As discussed above, the press forming apparatus 1 can accomplish the steps of (2) drawing, (3) upsetting and (4) restriking only in one process, merely by moving the upper die 2 downward. Therefore, the press forming apparatus 1 can continuously carry out the press forming on the workpiece W, by making (1) "blank setting" in which the upper die 2 and the lift die 11 are raised, and by setting the workpiece W on the lift die 11.

As apparent from the above description, according to this embodiment, the cylindrical section 41 is formed upon bending the outer peripheral portion W1 of the workpiece W under cooperation of the lift die 11 and the upsetting punch 6, which is accomplished only by moving downward the lift die 11 on which the disk-shaped workpiece W is mounted and the upsetting punch 6 disposed to face the lift die 11. Additionally, the "upsetting" is accomplished by contacting the pushing projection 15 to the cylindrical bent end 41*e*. As a result, the annular convex (or concave) section 44 at a high rigidity can be formed at the bottom section 43 of the workpiece W at one step without using a thick steel plate as the workpiece W.

According to this embodiment, the formed part at a high rigidity can be press-formed in one process so that it is not necessary to move the workpiece W and replace the punches. Therefore, a time required for press forming is greatly reduced thereby extremely improving a manufacturing efficiency. Additionally, according to this embodiment, a thick blank is unnecessary as the workpiece W thereby decreasing a load applied on the workpiece W during the press forming. As a result this embodiment makes it possible to reduce a material cost and prolong the life of the press forming apparatus.

In this embodiment, the lift die 11 and the upsetting punch 6 can be moved downward as a single body in a state where the workpiece W having the cylindrical section 41 is sandwiched between the lift die 11 and the upsetting punch 6 so that the formed part 40 can be formed in one process in which only the upper die 2 makes upward and downward movements as a basic operation of press forming.

In this embodiment, as shown in FIG. 7A, the surfaces (between which the workpiece W is sandwiched) of the upsetting punch 6 and the lift die 11 are respectively provided with the inner edge portions D and B which are radially aligned with each other. One of the inner edge portions D and B forms right angles in section, while the other edge portion is chamfered. Therefore, the chamfered inner edge portion is selectively formed in one of the upsetting punch 6 and the lift die 11 so that the bottom section 43 of the workpiece W can be selectively formed with the annular convex (or concave) section 44. Furthermore, in this configuration, the angle of an inclined surface constituting the annular convex (or concave) section 44 can be freely changed corresponding to the shape of the above-mentioned chamfered inner edge portion.

In this embodiment, as shown in FIG. 7B, it will be understood that the inner edge portions D and B are radially displaced from each other, the edge portions being respectively provided at the surfaces (between which the workpiece W is sandwiched) of the upsetting punch 6 and the lift die 11. In this configuration, the bottom section 43 of the workpiece W can be selectively formed with the annular convex (or concave) section 44 by selecting the inner edge D or the inner edge B as one to be set back.

In this embodiment, the detachable center punch 4 is disposed inside the upsetting punch 6 to form the upper bottom section (or central section) 43*a* surrounded by the annular convex (or concave) section 44 at the bottom section 43 of the workpiece W. Therefore, the center punch 4 can be suitably replaced so as to form the upper bottom section 43*a* on the bottom section 43 in various shapes corresponding to the dimension and shape of the center punch 4.

In this embodiment, the detachable punch 5 for forming the annular convex section is disposed between the center punch 4 and the upsetting punch 6 to restrict an amount of bend of the annular convex (or concave) section 44 at the bottom section 43 of the workpiece W. Therefore, the height (or depth) of the annular convex (or concave) section 44 can be variously changed corresponding to the shape of the punch 5 for forming the annular convex section.

In this embodiment, the run-off mechanism (7, 12 and 13) is provided for separating the pushing projection 15 from the cylindrical bent end 41*e* in accordance with an increase in pushing force from the cylindrical bent end 41*e*. Therefore, the cylindrical bent end 41*e* of the workpiece W never receives an unnecessary pushing force from the pushing projection 15 so that the bent section 42 of the workpiece W can be prevented from its buckling or the like. As a result, the formed part 40 can be formed at a high accuracy.

In this embodiment, the run-off mechanism (7, 12 and 13) is provided with the return means 20 for returning the pushing projection 15 to the initial position in accordance with a reduction in pushing force from the cylindrical bent end 41*e*. Therefore, it is unnecessary that the operator returns the pushing projection 15 after completion of the press forming, so that a continuous press forming process can be accomplished at short intervals. Additionally, in this embodiment, the outside wall 13W of the cam slide floor 13 has been discussed as a cylindrical one having the axis O; however, the outside wall 13W may be intermittently provided at positions corresponding to the cam slide dies 12.

FIGS. 8 to 12 illustrate a second embodiment of the press forming apparatus according to the present invention, similar to the first embodiment. FIGS. 8 to 12 are vertical cross-sectional views of the press forming apparatus 100 of the second embodiment, in which respective views show steps constituting a press forming method in time series. The workpiece W used in this embodiment has a cup-shaped intermediate product of the formed part 40 shown in FIG. 5B and includes the cylindrical section 41 and the bottom section 43 which are integrally connected with each other through the bent section 42.

The press forming apparatus 100 includes an upper die 120 and a lower die 130 similarly to the first embodiment. The lower die 130 includes a lower die plate 131 fixed on an elevating device (not shown). Lift bars Lb of the above-mentioned elevating device slidably pierce the lower die plate 131. Each lift bar Lb is fixed at its tip end with a base die 132 so that the base die 132 is retained to be movable upwardly and downwardly to the lower die plate 131.

The base die 132 includes a generally cylindrical or cup-shaped lift part 133 to which the tip end of the lift bar Lb is fixed. The lift part 133 is formed at its inside with a concave section of a cylindrical shape. Inside the concave section, a generally cylindrical center part 134 and a ring part 135 are detachably disposed. The ring part 135 surrounds the center part 134 and projects upwardly relative to the center part 134. In other words, the base die 132 includes a portion corresponding to an area including the annular convex section of the workpiece which portion consists of two parts 134 and 135. The lift part 133 includes an annular shoulder portion 133*s* whose annular edge section is curved or tapered. Similarly, the ring part 135 includes a pressing surface 135*f* provided with annular edge portions 135*e* curved or tapered.

Figure 8:
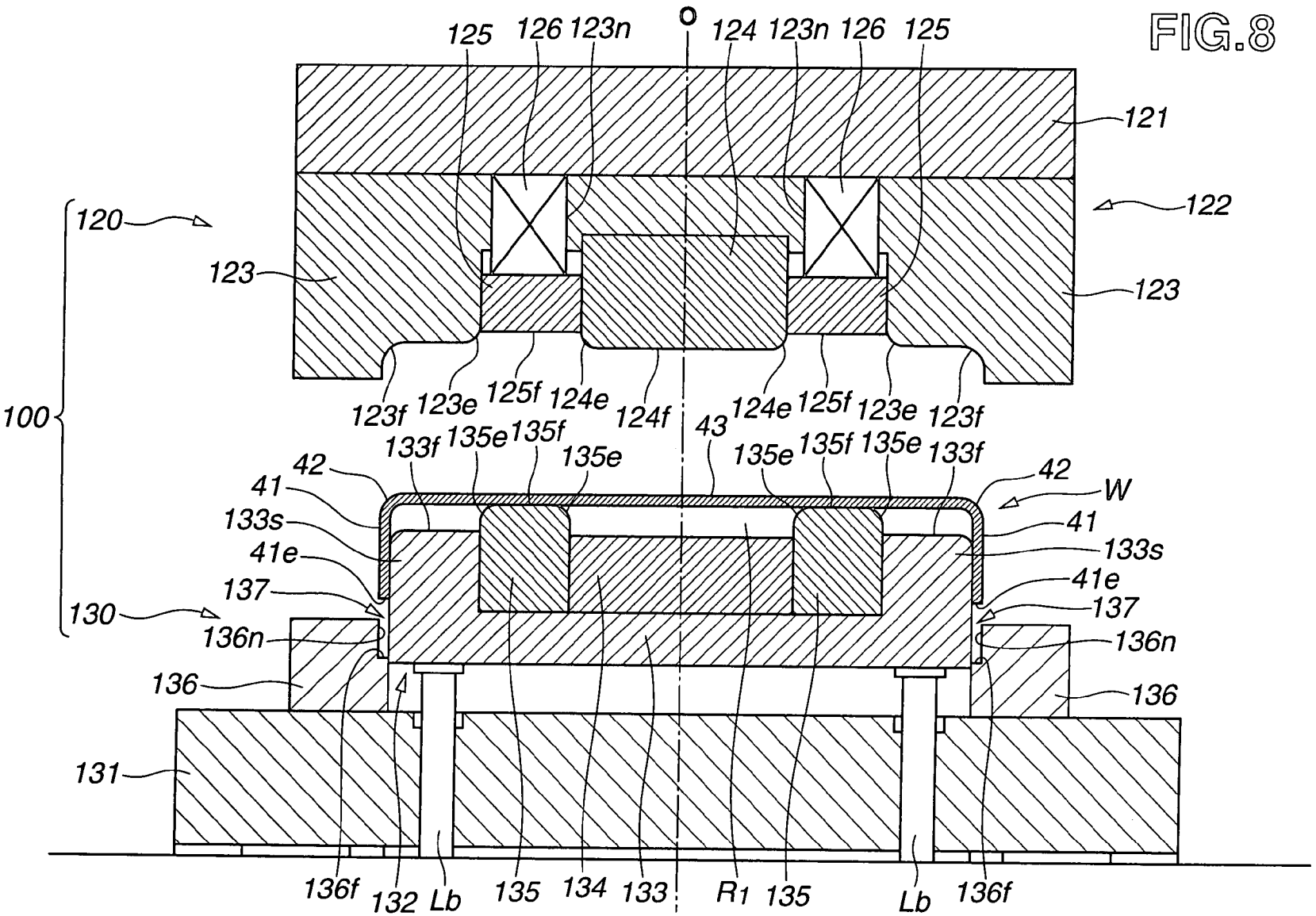
FIG. 8 is a vertical cross-sectional view of a second embodiment of a press forming apparatus according to the present invention, showing a "blank setting" state of the press forming apparatus.
Figure 9:
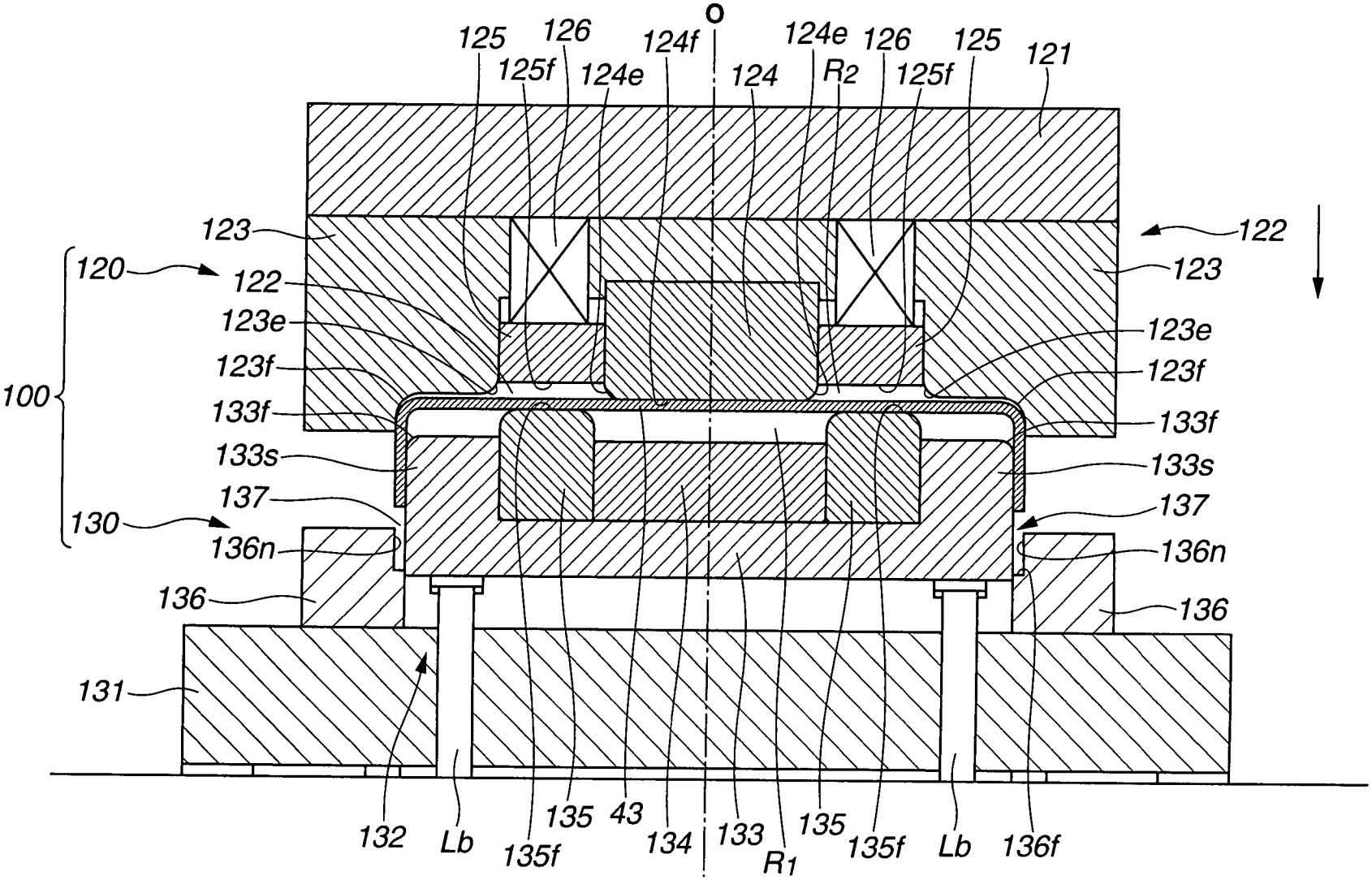
FIG. 9 is a vertical cross-sectional view of the press forming apparatus of FIG. 8, but showing a "striking" state between a base die and an upsetting punch of the press forming apparatus.

As shown in FIG. 9, the lower die plate 131 is provided with an upsetting die 136 which is disposed outside and adjacent to the base die 132 and fixed with the lower die plate 131. The upsetting die 136 is formed at its surface facing to the upper die 120 with an annular depression (or annular cutout) 136*n* defined by an annular depressed inner peripheral surface (not identified) as shown in FIG. 8. This depression 136*n* incorporates with the base die 132 to serve as a groove 137 into which a bent end 41*e* of the workpiece W can be inserted.

The upper die 120 includes an upper die plate 121 which is connected to an elevating device (not shown) and provided with an upsetting punch 122.

The upsetting punch 122 includes a generally cylindrical main part 123 fixed with the upper die plate 121. The main part 123 is formed at its inside with a cylindrical concave section. Inside the concave section, a generally cylindrical center part 124 and a ring part 125 are detachably disposed. The ring part 125 surrounds the center part 124 and depressed at its lower surface toward the upper die plate 121 with respect to the lower surface of the center part 124.

The main part 123 is formed with a plurality of through-holes 123*n* which are located around the center part 124. An elastic member (for example, a return spring) 126 is detachably disposed in each through-hole 123*n* so that the ring part 125 is elastically retained to the upper die plate 121. In other words, the upsetting punch 122 includes a portion corresponding to an area including the annular concave section which portion consists of three parts 124, 125, 126.

The main part 123 has an annular guide surface 123*f* formed at a section facing to the shoulder portion 133*s* of the lift part 133. The guide surface 123*f* is connected to the portion corresponding to the area including the above-mentioned annular concave section through an edge section 123*e* which is chamfered or tapered. The guide surface 123*f* is formed to be curved or tapered so as to have a shape similar to that of the shoulder portion 133*s* of the base die 132. When the upper die 120 approaches the lower die 130, the guide surface 123*f* is fitted with the bent section 42 contiguous with the bottom section 43 of the workpiece W mounted on the pressing surface 135*f* of the ring part 135. Therefore, the workpiece W is pressed by the guide surface 123*f* and by the pressing surface 133*f* of the lift part 133, and additionally the bent end 41*e* of the workpiece W is brought into contact with a striking surface 136*f* of the upsetting die 136.

Next, operation of the press forming apparatus 100 will be discussed with reference to FIGS. 8 to 12.

The press forming apparatus 100 can accomplish a press forming including three steps of (1) blank setting, (2) upsetting, and (3) restriking, only by moving the upper die 120 downward. Hereinafter, the steps of (1) to (3) will be successively discussed.

(1) Blank setting (see FIG. 8) "Blank setting" in this embodiment is a step for setting the workpiece W which is in the cup-shaped intermediate product.

As shown in FIG. 8, the upper die 120 is raised by a driving device (not shown) to a certain position which has been previously set, and stands by at the same position as in the first embodiment. Similarly, in the lower die 130, the base die 132 is raised by the above-mentioned elevating device from the lower die plate 131 to a certain position which has been previously set, and stopped at the certain position. By this, an operator can set the cup-shaped workpiece W on the base die 132. At this time, the cup-shaped workpiece W is set in a state of being turned upside down. In other words, the setting of the workpiece W is accomplished by mounting the bottom section 43 on the pressing surface 135*f* of the ring part 135, and by generally contacting the inside of the cylindrical section 41 to the outer peripheral surface contiguous with the shoulder portion 133*s* of the lift part 133.

Figure 10:
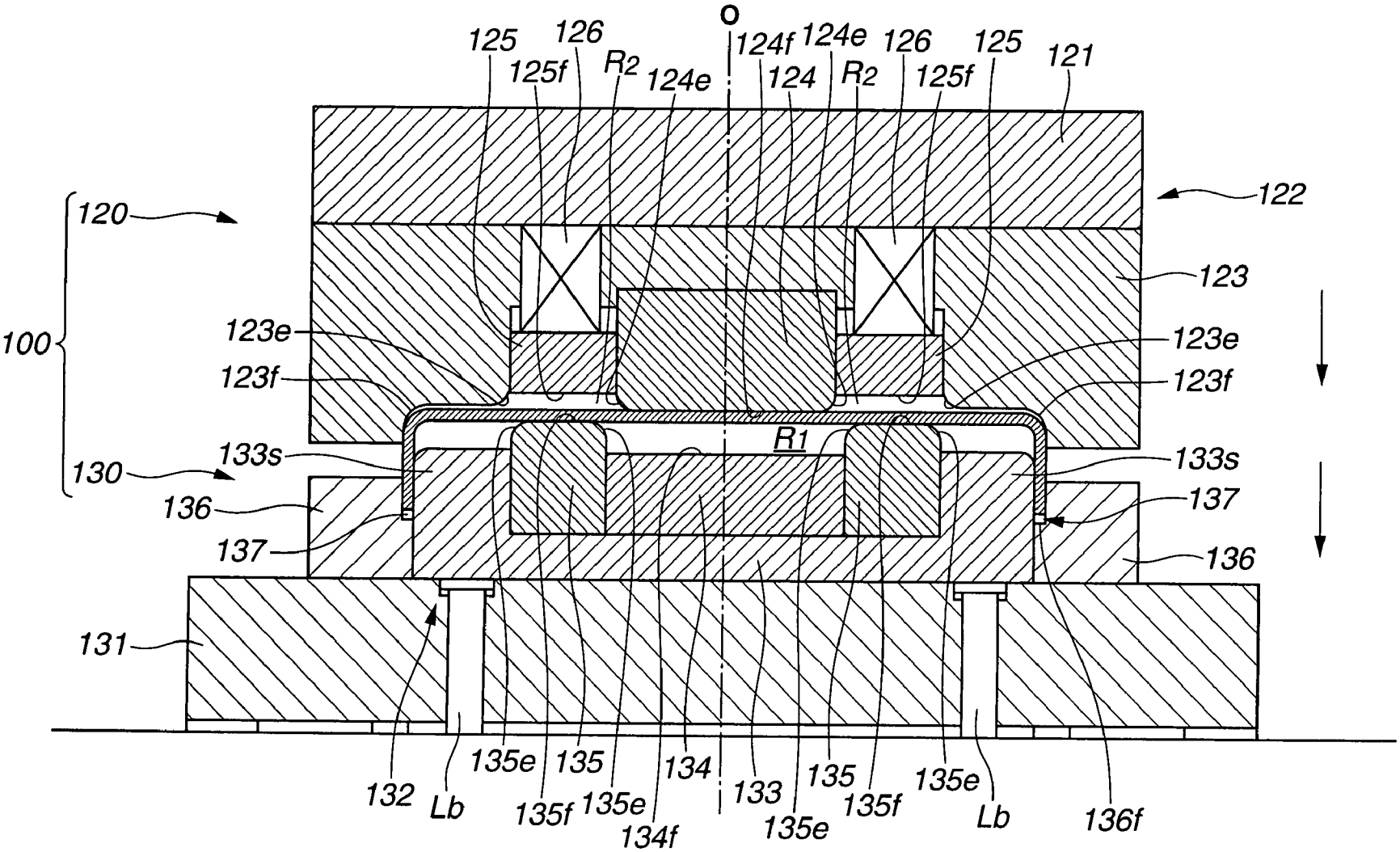
FIG. 10 is a vertical cross-sectional view of the press forming apparatus of FIG. 8, but showing a "downward movement" state of the base die and the upsetting punch of the press forming apparatus.
Figure 11:
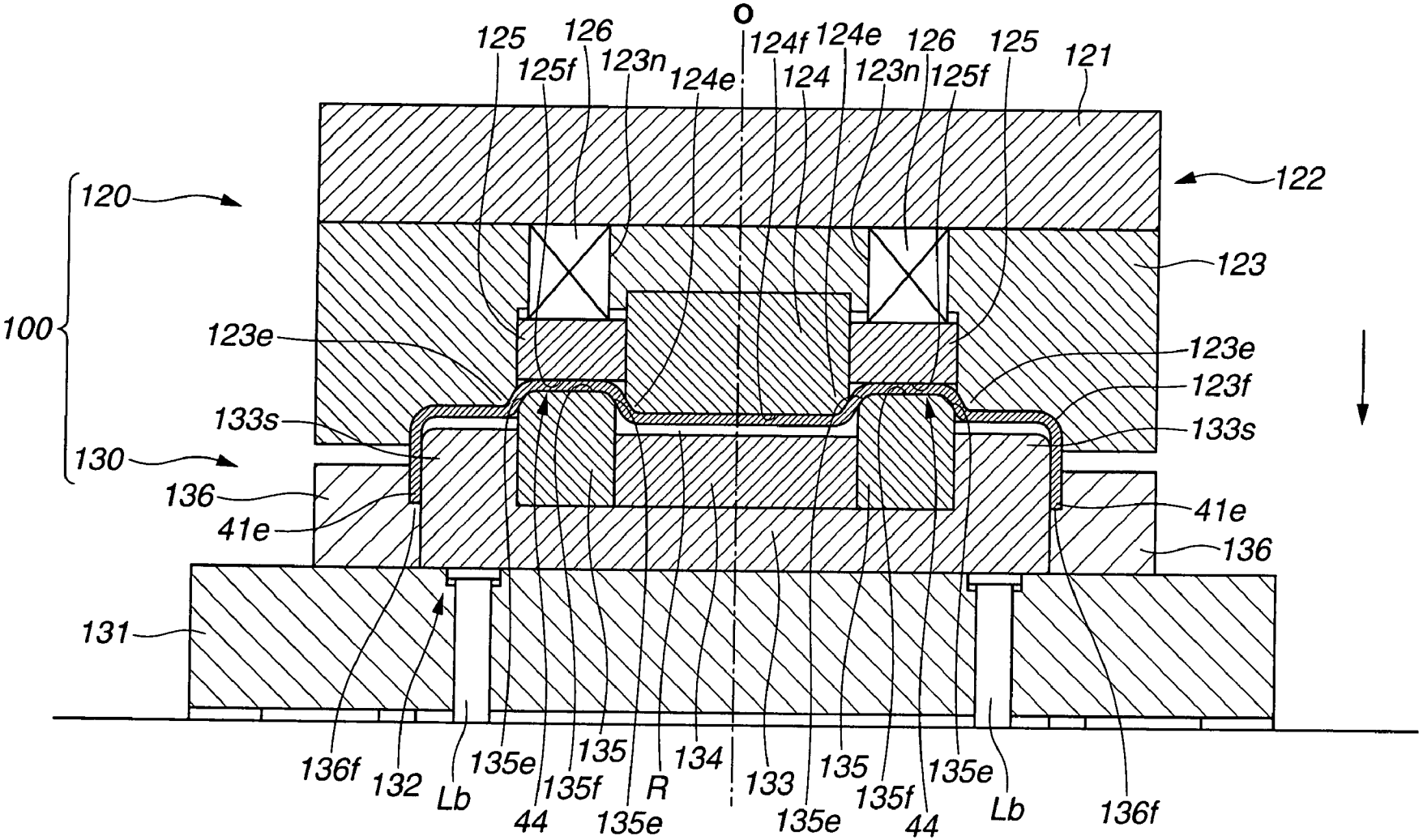
FIG. 11 is a vertical cross-sectional view similar to FIG. 8, but showing a state immediately prior to an "upsetting" of the press forming apparatus.

(2) Preliminary Forming (See FIGS. 9 to 11)

"Preliminary forming" is a step for preliminary forming the shape of the annular convex section 44 at the bottom section 43 of the workpiece W.

At this step, after setting the workpiece W, firstly the upper die 120 is moved downward toward the lower die 130 as shown in FIG. 9, in which the center part 124 of the upper die 120 is contacted with the bottom section 43 of the workpiece W. Thereafter, the base die 132 is moved downward until the base die 132 is contacted with the lower die plate 131 in a state where the workpiece W is sandwiched between the base die 132 and the upsetting punch 122 as shown in FIG. 10. The upper die 120 is further moved downward thereby initiating pushing of the center part 124 of the upper die 120 toward the center part 134 of the lower die 130. By this, the workpiece W is pressed toward the space R1, R2 defined between the center part 124 of the upper die 120 and the center part 134 of the lower die 130.

Thereafter, the upper die 120 is further moved downward so that the outside of the workpiece W is pressed by the main part 123 of the upsetting punch 122 in a state where the workpiece W is annularly sandwiched between the ring punch 125 of the upper die 120 and the ring part 135 of the lower die 130. By this, the bottom section 43 of the workpiece W is preliminary formed with the upper bottom section 43*a* and the annular convex section 44 surrounding the upper bottom section 43*a*. In this embodiment, the guide surface 124*f* of the center part 124 of the upper die 120 is configured to project relative to the guide surface 123*f* of the main part 123. However, this configuration can be suitably changed in accordance with the height (depth) of the upper bottom section 43*a* of the workpiece W.

Figure 12:
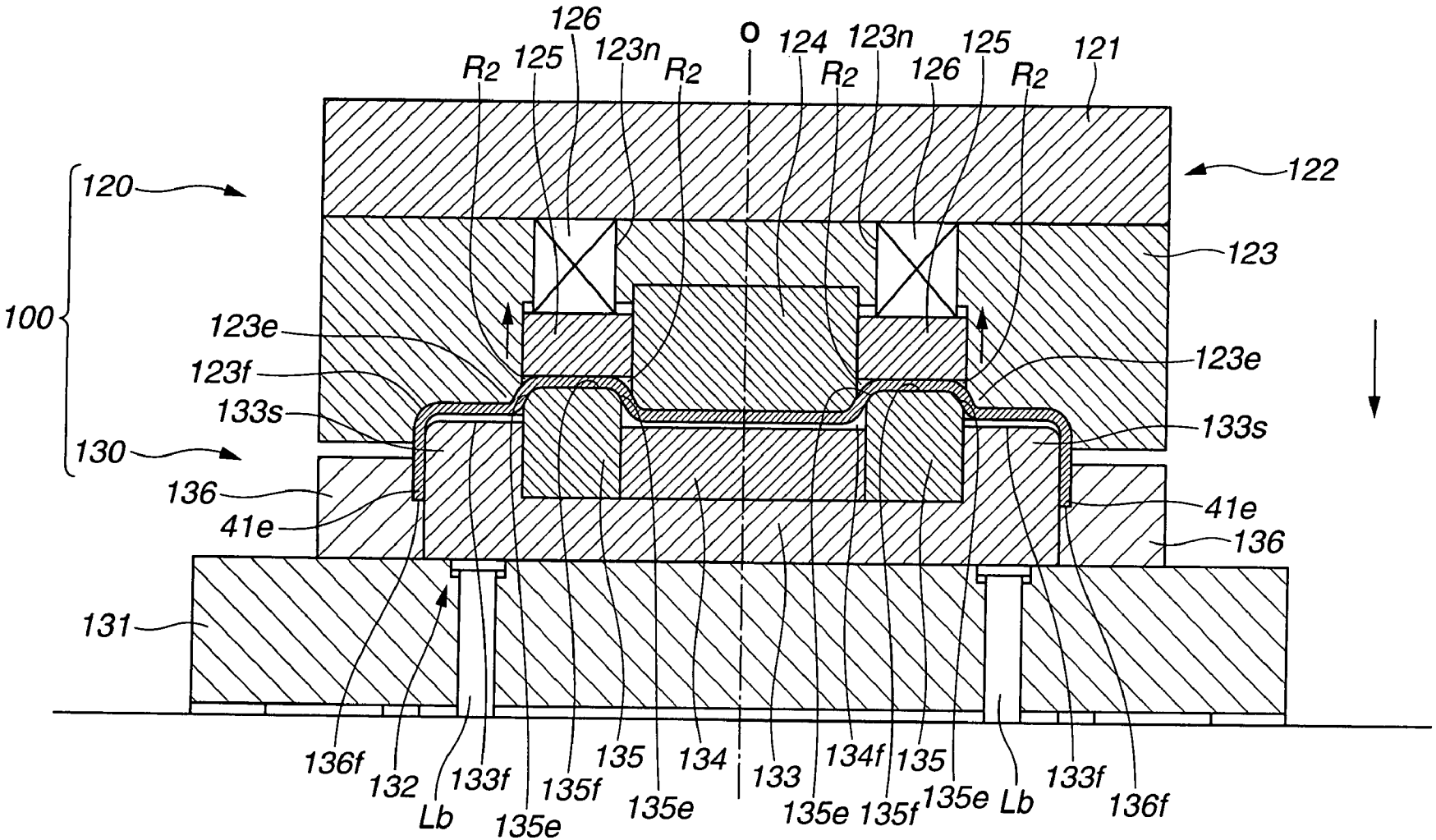
FIG. 12 is a vertical cross-sectional view similar to FIG. 8, but showing the "upsetting" state of the press forming apparatus.

(3) Upsetting (See FIGS. 11 and 12)

Simultaneously with the preliminary forming, the upsetting as same as in the first embodiment is accomplished to the workpiece W upon contacting the bent end 41*e* of the workpiece W to the striking surface 136*f* of the upsetting die 136.

More specifically, the upper die 120 is further moved downward so that the bent end 41*e* of the workpiece W pushes the upsetting die 136 as shown in FIG. 12. Therefore, the bent end 41*e* receives a pressing force directing to the center axis $O_w$ of the workpiece W so that the plastic flow directing from the bent end 41*e* to the bottom section 43 is produced in the workpiece W. Simultaneously, since the workpiece W is a disk shape, a reaction force acts on the pressing force from the bent end 41*e* in a direction from the center axis $O_w$ of the workpiece W to the bent end 41*e*. Consequently, the pressing force and the reaction force accomplish the upsetting along the space R1 on the workpiece W placed between the center part 124 of the upper die 120 and the center part 134 of the lower die 130, so that the upper bottom section 43*a* is formed at the center part of the bottom section 43 of the workpiece W. Simultaneously, the upsetting is accomplished also along space R2 defined between the ring part 125 of the upper die 120 and the ring part 135 of the lower die 130 so that the annular convex section 44 projecting opposite to the cylindrical section 41 is formed at the bottom section 43 of the workpiece W.

Particularly in this embodiment, the ring part 125 of the upper die 120 is elastically supported by the elastic member 126 so that volume of the space R2 is substantially variable. Therefore, if an elastic force of the elastic member 126 is suitably adjusted, it is possible to accomplish the upsetting for forming the outer shape of the workpiece W also in a state where the workpiece W is sandwiched between the ring part 125 of the upper die 120 and the ring part 135 of the lower die 130 similarly to in the above-mentioned first embodiment. Also in this case, the upsetting in which the bent end 41*e* is pushed by the upsetting die 136 is accomplished thereby producing the plastic flow in the workpiece W. As a result, it becomes possible to increase the thickness of the bent section 42 and the annular convex section 44 which tends to become relatively low in rigidity.

Figure 13:
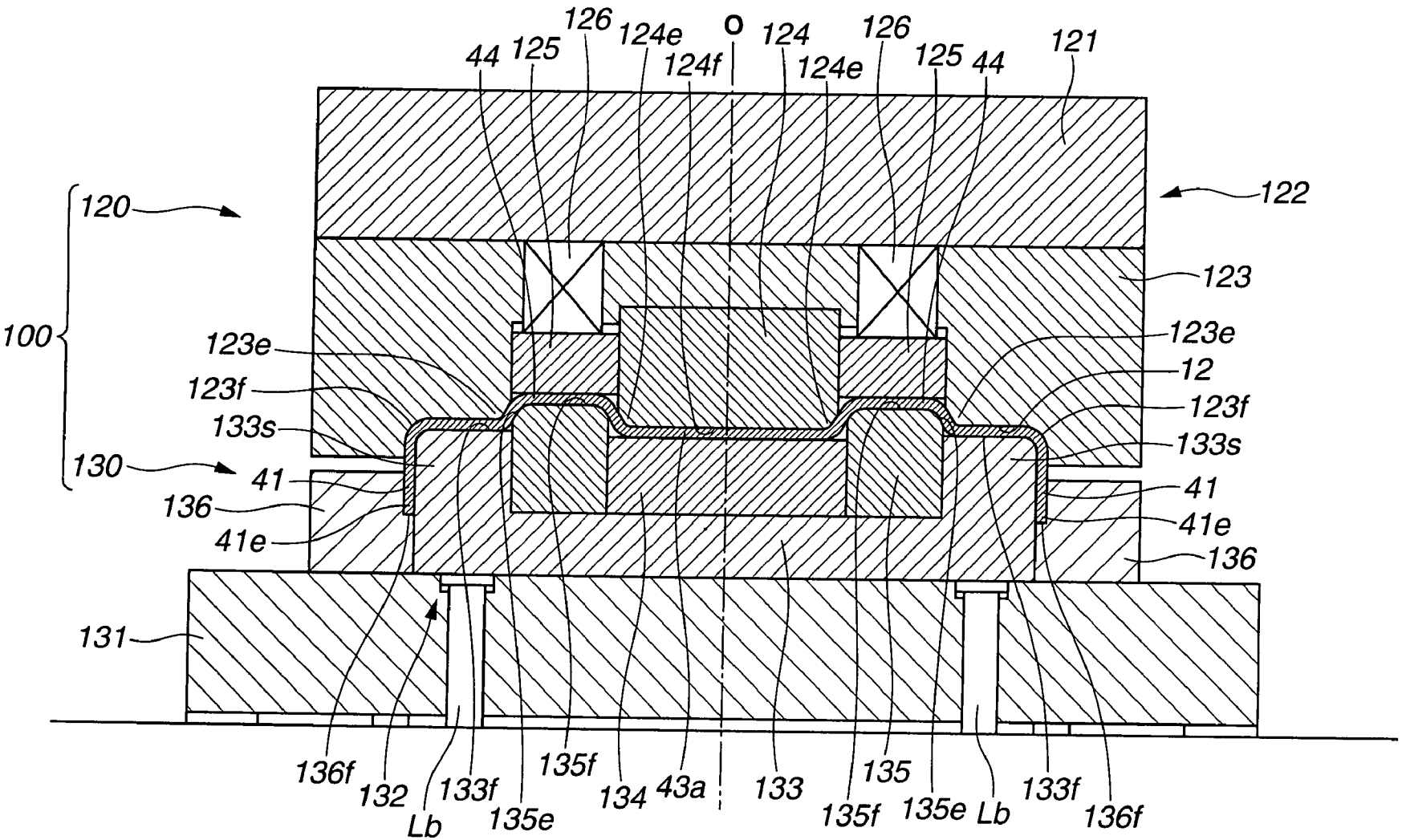
FIG. 13 is a vertical cross-sectional view similar to FIG. 8, but showing a "restriking" state of the press forming apparatus.

(4) Restriking (See FIG. 13)

The upper die 120 is further approached to the lower die 130 thereby striking the upper die 120 to the lower die 130. By this, the upper bottom section 43*a* is completely pressed between the center part 124 of the upper die 120 and the center part 134 of the lower die 130 as shown in FIG. 13 in a state where the annular convex section 44 is sandwiched between the ring part 125 of the upper die 120 and the ring part 135 of the lower die 130. Additionally, a circumferential area including the bent section 42 is also completely pressed between the main part 123 and the lift part 133. As a result, the shape of the bottom section 43 and the annular convex section 44 is adjusted similarly to in the first embodiment so that the formed part 40 can be finished.

The base die 132 is raised from the lower die plate 131 so as to eject the formed part 40. At this time, if the formed part 40 is in a state of being kept fitted in the upper die 120, the ring part 125 of the upper die 120 pushes the annular convex section 44 under the biasing force of the elastic member 126. Therefore, the formed part 40 can be ejected from the upper die 120. On the other hand, it will be understood that a biasing device is separately provided in case that the formed part 40 is kept fitted with the lower die 130, in which the upsetting die 136 is always upwardly biased to be raised and is moved downward upon receiving a larger force than the biasing force under the action of the biasing device. By this, the formed part 40 can be ejected from the lower die 130.

In this embodiment, each of the concave and the convex sections having a uniform thickness is formed upon the upsetting similarly to in the first embodiment. As apparent from the above, in the first embodiment, the workpiece W is press-formed by striking the upper die 2 to the corresponding lower die 3. At this time, the upper die 2 is approached to the lower die 3 so that the space R is defined between the upper die 2 and the lower die 3. The workpiece W set between the upper die 2 and the lower die 3 is forced into the space R upon the upsetting. Therefore, the workpiece W is subjected to the forming for providing the preliminary shape to the workpiece W. Additionally, the upper die 2 is struck to the lower die 3 to finish the formed part 40. On the other hand, in this embodiment, the upper die 120 is approached to the lower die 130 so that the workpiece W set between the upper die 120 and the lower die 130 is subjected to the forming for providing the preliminary shape to the workpiece W. Additionally, the workpiece W is forced into the spaces R1 and R2 defined between the upper die 120 and the lower die 130, under the action of the reaction force according to the preliminary forming. Furthermore, the upper die 120 is struck to the lower die 130 to finish the formed part 40.

In this embodiment, the preliminary forming, the upsetting and the finishing are accomplished in a state where the workpiece W is sandwiched between the ring part 125 of the upper die 120 and the ring part 135 of the lower die 130, so that the plastic flow is further promoted for the annular convex section 44. Therefore, in the second embodiment, an effect that the thickness in the annular convex section 44 is further increased can be obtained in addition to the effects obtained in the first embodiment.

The ring part 135 of the lower die 130 may be movable upwardly or downwardly relative to the lift part 133 upon being drivingly connected to the above-mentioned elevating device through the lift bar piercing the lift part 133 and the lower die plate 131. By this, the ring part 125 of the upper die 120 can be moved to a further deep position relative to the main part 123. In this case, the ring part 135 is raised relative to the lift part 133 thereby making it possible to secure a further increased height for the annular convex section 44 relative to the bottom section 43.

Additionally, the press forming apparatus 100 is for forming the annular convex section 44 at the bottom section 43. However, the annular concave section can be formed at the bottom section 43 similarly to in the first embodiment by replacing the configuration of the center part 124 and the ring part 125 of the upper die 120 with that of the center part 134 and the ring part 135 of the lower die 130 or vice versa. Furthermore, if the ring part 125 of the upper die 120 is configured to variably move, also the height (depth) of the annular concave section can be secured to further increase. In the press forming apparatus 100, the restriking is accomplished upon the striking between the upper die 120 and the lower die 130; however, the restriking may be again accomplished using a finishing apparatus as shown in FIG. 14 in order to accomplish a further secured finishing.

Figure 14:
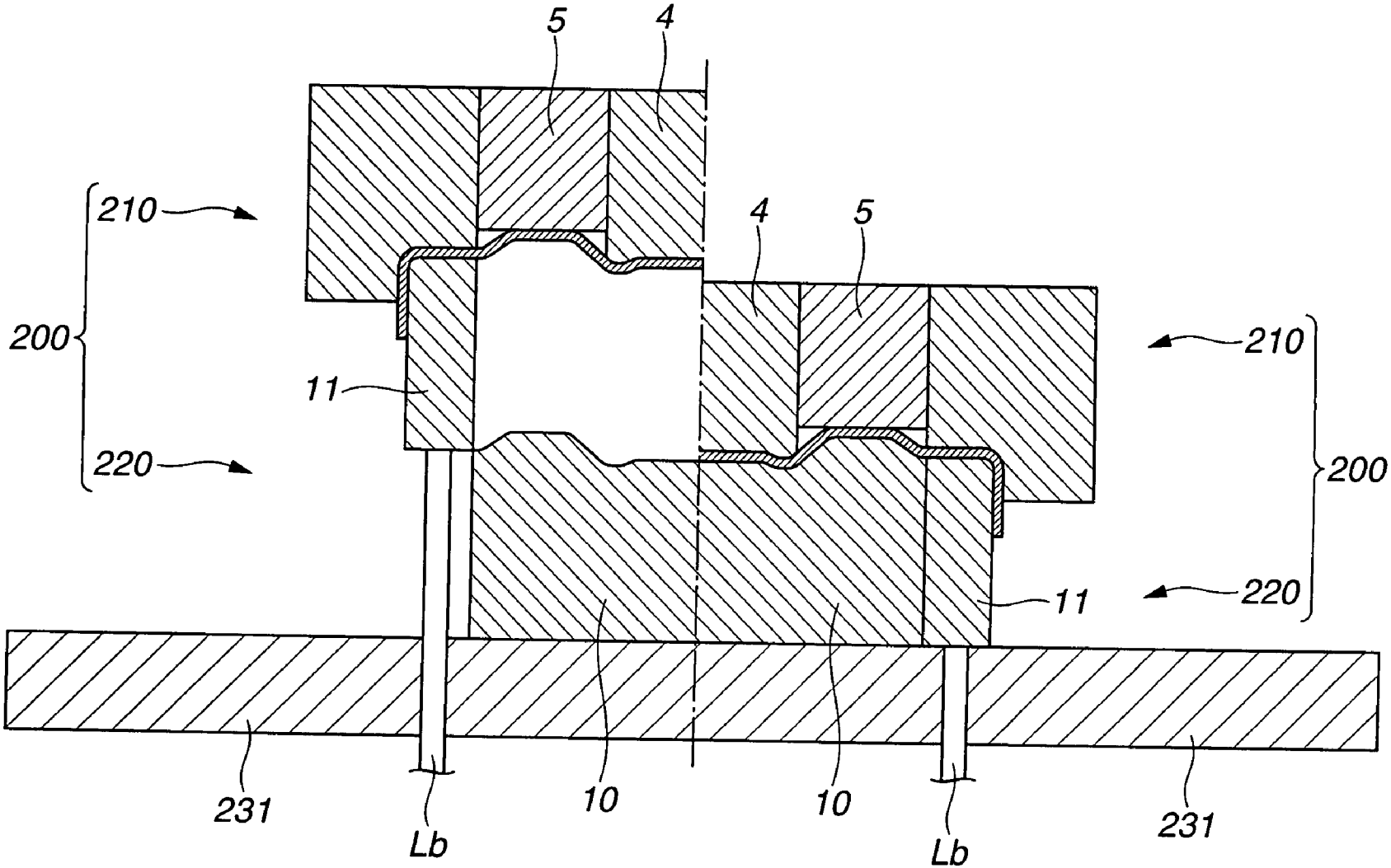
FIG. 14 is a vertical cross-sectional view, showing a finishing apparatus, in chronological order, used for a "restriking" separately accomplished in the second embodiment.

The finishing apparatus 200 as shown in FIG. 14 is obtained by partly modifying the press forming apparatus 1, in which the same parts are designated with the same reference numerals thereby omitting the description. Therefore, in FIG. 14, a left side half part shows a state where an upper die 210 (which will be discussed below) is raised, whereas a right side half part shows a state where the restriking is completed.

The finishing apparatus 200 includes an upper die 210 and a lower die 220 which has a lower die plate 231 fixed on the elevating device (not shown). The lower die plate 231 is provided with the core die 10 and the lift die 11 similarly to in the first embodiment. The upper die 220 is also provided with the core punch including the center punch 4 and the punch 5 for forming the annular convex section similarly to in the first embodiment, and a drawing punch 9.

Hereinafter, the restriking in this embodiment will be discussed. Firstly, the upper die 220 and the lift die 11 are raised, and thereafter the formed part 40 ejected from the press forming apparatus 100 is turned upside down and mounted on the lift die 11. Next, the lift die 11 is moved downward to the lower die plate 231, and thereafter the upper die 220 is moved downward to be struck to the lower die 130. Consequently, the restriking similarly to in the first embodiment is accomplished.

Figure 15:
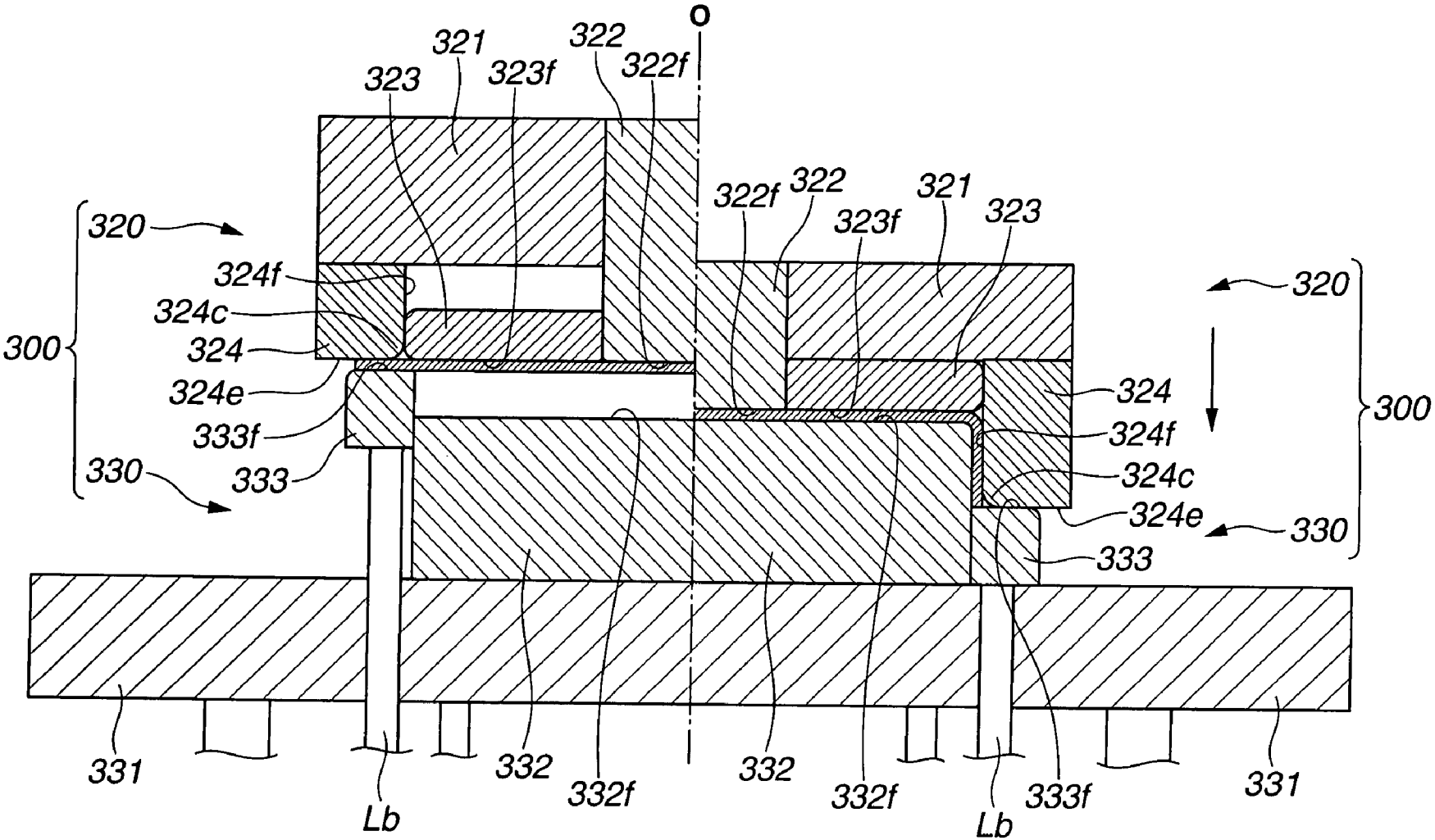
FIG. 15 is a vertical cross-sectional view, showing another example of a press forming apparatus, in chronological order, for forming an intermediate product used in the second embodiment.

FIG. 15 shows an example of a press forming apparatus 300 which is used for forming the cup-shaped intermediate product from the disk-shaped workpiece W. In FIG. 15, a left side half part shows a state where an upper die 320 (which will be discussed below) is raised, whereas a right side half part shows a state where the press forming is completed.

The press forming apparatus 300 includes an upper die 320 and a lower die 330. The lower die 330 has a lower die plate 331 fixed on the elevating device (not shown). The lower die plate 331 is provided with a generally cylindrical core die 332 for forming an inside of a bottom section of the intermediate product. The lift bar Lb of the above-mentioned elevating device slidably pierces the lower die plate 331. The tip end of the lift bar Lb is fixed with an annular lift die 333. With this, the lift die 333 is always upwardly pushed in a direction opposite to the lower die plate 331 by a constant biasing force.

However, in case that a force more than the biasing force is applied to the lift die 333, the lift die 333 is moved downward against the biasing force.

The upper die 320 includes an upper die plate 321 connected to the elevating device (not shown). The upper die plate 321 slidably supports a center punch 322 located coaxially with an axis O of the apparatus. The center punch 322 slidably supports a disk punch 323 which has an outer diameter generally the same as that of the bottom section 43 of the formed part 40.

In this example, a space is formed between the upper die plate 321 and the disk punch 323 thereby allowing the disk punch 323 to slidably move. An elastic member such as a return spring or the like (not shown) is disposed inside the space so that the disk punch 323 is elastically supported by the upper die plate 321. A drawing punch 324 is disposed outside the disk punch 323 and adjacent to the disk punch 323 thereby surrounding the disk punch 323. Therefore, the disk punch 323 is slidably movable along the inner peripheral surface of the center punch 322 and the drawing punch 324 in a direction of approaching toward and separating from the upper die plate 321.

Hereinafter, the preliminary forming in this example will be discussed. Firstly, the disk-shaped workpiece W is coaxially mounted on the lift die 333. Then, the upper die 320 is moved downward to be contacted with the workpiece W in a state where an end surface 322*f* of the center punch 322, a flat end surface 323*f* of the disk punch 323 and an end surface 324*e* of the drawing punch 324 are flush with each other. Subsequently, the workpiece W is sandwiched between the upper die 320 and the lift die 333 and moved downward.

When the workpiece W reaches a supporting or holding surface 332*f* of the core die 332, the elastic member disposed between the upper die plate 321 and the disk punch 323 as described above (not shown) is compressed. Therefore, the upper die 320 is further moved downward so that the drawing punch 324 pushes the lift die 333 in a state where the workpiece W is contacted with the supporting or holding surface 332*f* of the core die 332. Accordingly, in case that a pushing force of the drawing punch 324 is larger than a biasing force applied to the lift die 333, the upper die 320 is continued to move downward against the biasing force. As a result, the outer peripheral portion W1 of the workpiece W is bent by the lift die 333 and the drawing punch 324 as shown in a right side half part of FIG. 15 thereby forming the cylindrical section 41.

In this embodiment, the workpiece W is sandwiched between the side of the center punch 322 and the disk punch 323 of the upper die 320 and the side of the core die 332 of the lower die 330, so that the bottom section 43 can be prevented from being curved. Additionally, an inner peripheral portion 324*c* of the lower end section of the drawing die 324 is chamfered so that the workpiece W is prevented from being damaged during its bending.

After forming the cylindrical section 41 in the workpiece W, the upper die 320 is raised so that the lift die 333 is again raised under the biasing force of the biasing device (not shown). Therefore, the cup-shaped intermediate product including the cylindrical section 41 and the bottom section 43 can be ejected upon only raising the upper die 320. In this case, if the intermediate product is kept to fit in the upper die 320, the bottom section 43 is pushed by the biasing force of the elastic member (not shown) through the disk punch 323 so that the formed part 40 can be ejected from the upper die 120.

As discussed above, discussion has been made on the preferable embodiments for carrying out the present invention. The invention is not limited to the embodiments described above. Modifications and variations of the embodiment described above will occur to those skilled in the art, in light of the above teachings. For example, in case that the convex (or concave) section is formed at the bent disk-shaped workpiece, the formed part is not limited to a cup-shaped one and therefore may be a L-shaped (in section) angle bar. Additionally, the press formed convex (or concave) section is not limited to one in a continuous annular shape and therefore the convex (or concave) section may be one in an intermittent shape. Concerning the configuration of each apparatus discussed above, constituting elements of the apparatuses may be suitably replaced or combined with each other in accordance with an operating condition. For example, the elevating means for the lift die or the like may be replaced with a driving device or the biasing device.

Hereinafter, discussion will be made on technical ideas comprehended from the above embodiments.

(1) A press forming method includes the following steps: (a) approaching an upper die to a lower die to form a space having a shape corresponding to at least one of concave and convex, the upper die having at least one of convex and concave, the lower die having at least one of concave and convex corresponding to at least one of convex and concave of the upper die; (b) forcing a workpiece disposed between the upper and lower dies, into the space so as to form at least one of preliminary concave and convex in the workpiece; (c) striking the upper die against the lower die so as to form at least one of concave and convex in the workpiece.

With the above idea, the step for forming the convex or concave in the workpiece and the step of the upsetting are simultaneously accomplished at a stretch or one stroke. Therefore, the formed part including convex (or concave) section high in rigidity can be press-formed at fewer steps than a conventional method. As a result, a time required for the press forming is greatly reduced thereby extremely improving a manufacturing efficiency. Additionally, with the above idea, the upsetting promotes the plastic flow of the workpiece so that the workpiece is formed to increase in thickness. Accordingly, a thick blank is unnecessary as the workpiece W thereby decreasing a load applied on the workpiece W during the press forming. As a result, this idea makes it possible to reduce a material cost and prolong the life of a press forming apparatus used for the press forming method.

(2) A press forming method includes the following steps: (a) approaching an upper die to a lower die to form at least one of preliminary concave and convex in a workpiece disposed between the upper and lower dies so as to accomplish a preliminary forming, the upper die having at least one of convex and concave, the lower die having at least one of concave and convex corresponding to at least one of convex and concave of the upper die; (b) forcing the workpiece disposed between the upper and lower dies into a forming space by using a reaction force due to the preliminary forming, the forming space being formed between the upper and lower dies; (c) striking the upper die against the lower die so as to form at least one of concave and convex in the workpiece.

With the above idea, in addition to the effects of the idea described in (1), the plastic flow of the workpiece is further promoted so that the convex (or concave) section is formed to further increase in thickness.

(3) A press forming apparatus includes a lower die. The lower die includes a first punch on which a disk-shaped workpiece is to be mounted. A pushing projection is disposed outside the first punch and adjacent to the first punch so as to accomplish an upsetting for the workpiece upon contacting with a cylindrical bent end of the workpiece. An upper die includes a drawing die disposed to face to the first punch and cooperating with the first punch upon approaching the lower die so as to form a cylindrical section in the workpiece by bending the outer peripheral portion of the workpiece upon the approaching of the upper die. The upper die is struck to the lower die so as to press-form a cup-shaped formed part. The formed part includes the cylindrical section and a bottom section contiguous with the cylindrical section, and formed with at least one of annular concave or convex.

With the above idea, the cylindrical section of the workpiece is formed upon bending the outer peripheral portion of the workpiece under cooperation of the first punch and the drawing die, which is accomplished only by moving downward the first punch on which the disk-shaped workpiece W is mounted and the drawing die disposed facing the first punch. Additionally, the "upsetting" is accomplished by contacting the pushing projection to the cylindrical bent end of the above-mentioned cylindrical section. As a result, the annular convex (or concave) section high in rigidity can be formed at the bottom section of the workpiece at a stretch without using a thick steel plate as the workpiece.

According to the above idea, the formed part high in rigidity can be press-formed at one step thereby making it unnecessary moving the workpiece, replacing the punches, and the like. Therefore, a time required for press forming can be greatly reduced thereby extremely improving a manufacturing efficiency. Additionally, according to the idea described in (1), a thick blank is unnecessary for the workpiece thereby decreasing a load applied to the workpiece W during the press forming. As a result, this idea makes it possible to reduce a material cost and prolong the life of the press forming apparatus.

(4) A press forming apparatus as described in idea (3), in which the first punch is a lift punch which is movable with the drawing die as a single member in a state where the workpiece having the cylindrical section is sandwiched between the first punch and the drawing die.

With the above idea, the above-mentioned first punch and the drawing die can be moved downward as a single body in a state where the workpiece having the cylindrical section is sandwiched between the first punch and the drawing die so that the formed part can be formed at one step in which only one of the dies makes its upward and downward movements as a basic operation of the press forming.

(5) A press forming apparatus as described in idea (3), in which the first punch and the drawing die are respectively having, at their holding surfaces, edge portions which are aligned with each other in a radial direction of the first punch and the drawing die. One of edge portions forms at generally right angles in section. The other edge portion is chamfered.

With the above idea, the surfaces (between which the workpiece W is sandwiched) of the above-mentioned first punch and the above-mentioned drawing die are respectively provided with the inner edge portions which are radially aligned with each other. One of the inner edge portions forms right angles in section, while the other edge portion is chamfered. Therefore, the chamfered inner edge portion is selectively formed on one of the first punch and the above-mentioned drawing die so that the bottom section of the above-mentioned workpiece can be selectively formed with the annular convex (or concave) section. Furthermore, in this configuration, the angle of an inclined surface constituting the annular convex (or concave) section can be freely changed corresponding to the shape of the above-mentioned chamfered inner edge portion.

(6) A press forming apparatus as described in idea (3), in which the first punch and the drawing die are respectively having, at their holding surfaces, edge portions which are different in position from each other in the radial direction of the first punch and the drawing die.

With the above idea, the inner edge portions are radially displaced from each other, the edge portions being respectively provided at the surfaces (between which the workpiece W is sandwiched) of the above-mentioned first punch and the above-mentioned drawing die. In this configuration, the bottom section of the above-mentioned workpiece can be selectively formed with the annular convex (or concave) section by selecting either one of the inner edges to be set back.

(7) A press forming apparatus as described in idea (3), in which a center punch is detachably disposed radially inside the drawing die so as to press a central section of the workpiece surrounded with at least one of the annular convex and concave.

With the above idea, the detachable center punch is disposed inside the above-mentioned drawing die to push the central section surrounded by the above-mentioned annular convex (or concave) section. Therefore, the center punch can be suitably changed in structure so as to form the central section surrounded by the above-mentioned annular convex (or concave) section at the bottom section of the work piece in various shapes corresponding to the dimension and shape of the center punch.

(8) A press forming apparatus as described in idea (7), wherein a punch for forming at least one of the annular convex and concave is detachably disposed radially between the drawing die and the center punch so as to restrict an amount of bend of at least one of the annular convex and concave formed at the bottom section of the workpiece.

With the above idea, the detachable punch is disposed between the above-mentioned drawing die and the above-mentioned center punch to restrict an amount of bend of the annular convex (or concave) section at the bottom section of the above-mentioned workpiece. Therefore, the height (or depth) of the above-mentioned annular convex (or concave) section can be variously changed corresponding to the shape of the above-mentioned punch.

(9) A press forming apparatus as described in idea (3), wherein the lower die includes a run-off mechanism for separating the pushing projection from the cylindrical end section of the workpiece in accordance with an increase in a pushing force from an end portion of the cylindrical section of the workpiece.

With the above idea, the run-off mechanism is provided for separating the pushing projection from the cylindrical bent end in accordance with an increase in the pressing force from the cylindrical bent end 41*e*. Therefore, the cylindrical bent end of the workpiece never receives an unnecessary pressing force from the pushing projection so that the bent section of the workpiece can be prevented from its buckling or the like. As a result, the formed part can be formed at a high accuracy.

(10) A press forming apparatus as described in idea (9), in which the lower die includes a return device for returning the pushing projection to an initial position in accordance with a reduction in the pushing force from the end portion of the cylindrical section of the workpiece.

With the above idea, the above-mentioned run-off mechanism is provided with the return means for returning the above-mentioned pushing projection to the initial position in accordance with a reduction in the pressing force from the above-mentioned cylindrical bent end. Therefore, it is unnecessary that the operator returns the above-mentioned pushing projection after completion of the press forming, so that a continuous press forming process can be accomplished at short intervals.

(11) A press forming apparatus includes a lower die. The lower die has at least one of concave and convex, and includes a core die having at least one of concave and convex. A lift die is disposed radially outside and adjacent to the core die and movable upward and downward relative to the core die in a state where a disk-shaped workpiece is mounted on the lift die. An upsetting die is disposed radially outside and adjacent to the lift die and contactable with a bent end of the workpiece which has been bent upon downward movement of the lift die. An upper die has at least one of convex and concave corresponding to the shape in the lower die and includes a core punch having at least one of convex and concave corresponding to at least one of the concave and convex of the core die. An upsetting punch is located radially outside and adjacent to the core punch and having a projection for bending an outer peripheral portion of the workpiece mounted on the lift die, and a holding surface for contacting the bent end of the workpiece to the upsetting die in cooperation with the lift die so as to force the workpiece into a space formed between the core die and the core punch by using a reaction force due to contacting of the bent end of the workpiece. The upper die is approached to the lower die to bent the disk-shaped work piece, and struck to the lower die to form at least one of convex and concave in the disk-shaped work piece.

With the above idea, three steps can be accomplished by operating only one of the upper die and the lower die in one process without moving the workpiece and replacing the punches or the dies. The three steps includes the step at which the outer peripheral portion of the workpiece is bent so as to form the cylindrical section, the step for forming the convex (or concave) section at the workpiece, and the step for the upsetting. Therefore, the cup-shaped formed part including the convex (or concave) section high in rigidity can be press-formed by fewer steps than a conventional press forming apparatus. As a result, a time required for the press forming is greatly reduced thereby extremely improving a manufacturing efficiency. Additionally, with the above idea, the upsetting promotes the plastic flow of the workpiece so that the workpiece is formed to increase in thickness. Accordingly, a thick blank is unnecessary for the workpiece W thereby decreasing a load applied on the workpiece W during the press forming. As a result this idea makes it possible to reduce a material cost and prolong the life of the apparatus.

(12) A press forming apparatus as described in idea (11), in which the lift die and the upsetting punch have respectively edge portions which are contiguous with radially inside parts of the holding surfaces of the lift die and the upsetting punch. The edge portions are aligned with each other. One of the edge portions forms generally right angles. The other edge portion is chamfered.

With the above idea, the chamfered inner edge portion is selectively formed at one of the holding surface of the lift die and the curved surface of the upsetting punch so that the above-mentioned workpiece can be selectively formed with the annular convex (or concave) section. Furthermore, in this configuration, the angle of the inclined surface constituting the annular convex (or concave) section can be freely changed corresponding to the shape of the above-mentioned chamfered inner edge portion.

(13) A press forming apparatus as described in idea (11), in which the lift die and the upsetting punch have respectively edge portions which are contiguous with radially inside parts of the holding surfaces of the lift die and the upsetting punch. The edge portions are different in position from each other.

With the above idea, the above-mentioned workpiece can be selectively formed with the annular convex (or concave) section by selecting either one of the inner edges to be set back.

(14) A press forming apparatus as described in idea (11), in which at least one of the core die and the core punch includes a plurality of detachable parts which constitute a portion corresponding to an area of the workpiece which area includes at least one of the convex and the concave.

With the above idea, a plurality of the parts are suitably selected thereby suitably changing the shape and the height (depth) of the convex (or concave) section in the portion corresponding to the area including the convex (or concave) section and the shape in a portion corresponding to the area excepting the convex (or concave) section.

(15) A press forming apparatus as described in idea (11), in which the lower die includes a run-off mechanism operatively disposed to the upsetting die so as to separate the upsetting die from the bent end in accordance with an increase in pushing force from the bent end of the workpiece.

With the above idea, the cylindrical bent end of the workpiece never receives an unnecessary pressing force from the pushing projection after forming the convex (or concave) section at the workpiece so that the bent section of the workpiece can be prevented from its buckling or the like. As a result, the formed part can be formed at a high accuracy.

(16) A press forming apparatus as described in idea (15), in which the lower die includes a return device for returning the upsetting die to an initial position in accordance with a reduction in the pushing force from the bent end of the workpiece.

With the above idea, it is unnecessary that the operator returns the above-mentioned pushing projection after completion of the press forming, so that a continuous press forming process can be accomplished at short intervals.

(17) A press forming apparatus includes a lower die. The lower die has at least one of concave and convex, and includes a base die having at least one of concave and convex, and an upsetting die disposed radially outside and adjacent to the base die and formed with a depression serving as a groove between the upsetting die and the base die. A bent end of a workpiece is insertable in the groove. An upper die is formed into at least one of convex and concave shape corresponding to the shape in the lower die and includes an upsetting punch having at least one of convex and concave corresponding to at least one of the concave and convex of the base die, and a guide surface for contacting the bent end of the workpiece pressed to the upsetting punch in cooperation with the base die to the upsetting die so as to force the workpiece into a space formed between the base die and the upsetting punch by using a reaction force due to contacting of the bent end of the workpiece. The upper die is approached and struck to the lower die to form at least one of convex and concave in the bent disk-shaped work piece.

With the above idea, two steps can be accomplished in one process without moving the workpiece and replacing the punches or the dies. The two steps include the step for forming the convex (or concave) section at the bent cylindrical workpiece, and the step for the upsetting. Therefore, the cup-shaped formed part including the convex (or concave) section high in rigidity can be press-formed by fewer steps than a conventional press forming apparatus. As a result, the time required for the press forming is greatly reduced thereby extremely improving a manufacturing efficiency. Additionally, with the above idea, the upsetting is also accomplished so that a thick blank is unnecessary for the workpiece W thereby decreasing a load applied on the workpiece W during the press forming. As a result this idea makes it possible to reduce a material cost and prolong the life of the apparatus. Particularly with the above idea, the workpiece W is sandwiched between the upsetting punch and the base die so that the bent end of the work piece is contacted with the upsetting die. Therefore, the plastic flow can be further promoted in the convex (or concave) section of the workpiece so that the convex (or concave) section can be formed to further increase in thickness.

(18) A press forming apparatus as described in idea (17), in which the base die is a lift die movable upward and downward with the workpiece as a single body in a state of supporting the workpiece.

With the above idea, by moving the base die upward and downward, setting of the bent disk-shaped workpiece and ejecting of the formed part can be facilitated. As a result, the manufacturing efficiency is further improved.

(19) A press forming apparatus as described in idea (17), in which at least one of the base die and the upsetting punch includes a plurality of detachable parts which constitute a portion corresponding to an area of the workpiece which area includes at least one of the convex and the concave.

With the above idea, a plurality of the parts are suitably selected thereby suitably changing the shape and the height (depth) of the convex (or concave) section in the portion corresponding to the area including the convex (or concave) section and the shape in a portion corresponding to the area excepting the convex (or concave) section.

(20) A press forming apparatus as described in idea (17), further includes an elastic member disposed to bias at least one of the base die and the upsetting punch at the portion corresponding to an area of the workpiece including at least one of the convex and concave.

With the above idea, also in a state the workpiece is pressed between the base die and the upsetting punch to accomplish the upsetting, the plastic flow is relatively smoothly produced in the workpiece so that the thickness of the formed part can be generally unifomized.

Although the invention has been described above by reference to certain embodiments and examples of the invention, the invention is not limited to the embodiments and examples described above. Modifications and variations of the embodiments and examples described above will occur to those skilled in the art, in light of the above teachings. The scope of the invention is defined with reference to the following claims.

The entire contents of Japanese Patent Applications No. 2005-122598, filed Apr. 20, 2005 and No. 2006-062982, filed Mar. 8, 2006 are incorporated by reference.

What is claimed is:

1. A press forming method comprising the following steps:

approaching an upper die to a lower die to form at least one of preliminary concave and convex in a workpiece disposed between the upper and lower dies so as to accomplish a preliminary forming, the upper die having at least one of convex and concave, the lower die having at least one of concave and convex corresponding to at least one of convex and concave of the upper die;

forcing the workpiece disposed between the upper and lower dies into a forming space under upsetting, the forming space being formed between the upper and lower dies; and striking the upper die against the lower die so as to form at least one of concave and convex in the workpiece, wherein the lower die comprises a first punch and a pushing projection disposed outside and adjacent to the first punch, the upper die comprises a drawing die disposed to face the first punch, and the workpiece is disc-shaped and comprises an outer peripheral portion.

2. A press forming method comprising the following steps:

approaching an upper die to a lower die to form a space having a shape corresponding to at least one of concave and convex, the upper die having at least one of convex and concave, the lower die having at least one of concave and convex corresponding to at least one of convex and concave of the upper die;

forcing a workpiece disposed between the upper and lower dies under upsetting, into the space so as to form at least one of preliminary concave and convex in the workpiece; and striking the upper die against the lower die so as to form at least one of concave and convex in the workpiece, wherein the lower die comprises a first punch and a pushing projection disposed outside and adjacent to the first punch, the upper die comprises a drawing die disposed to face the first punch, and the workpiece is disc-shaped and comprises an outer peripheral portion.

3. The press forming method of claim 2, wherein the approaching of the upper die to the lower die further comprises bending the outer peripheral portion of the workpiece to form a cylindrical section comprising a bent end;

wherein the striking the upper die against the lower die comprises forming a cup-shaped part comprising the cylindrical section and a bottom section contiguous with the cylindrical section;

wherein the upsetting comprises contacting the pushing projection to the bent end; and wherein the at least of one concave and convex formed in the workpiece is high in rigidity.

4. The press forming method of claim 2 wherein the forming at least one of concave and convex in the workpiece occurs simultaneously with the upsetting.

5. The press forming method of claim 2 wherein the upsetting promotes a plastic flow of the workpiece such that the workpiece increases in thickness.

6. The press forming method of claim 2 wherein the forming of at least one of concave and convex in the workpiece occurs in one step.

* * * * *